US011267623B2

(12) United States Patent
Karlik

(10) Patent No.: US 11,267,623 B2
(45) Date of Patent: Mar. 8, 2022

(54) VARIABLE FLOW CAP ASSEMBLY FOR A DRINKING VESSEL

(71) Applicant: Simon Karlik, Cromer (AU)

(72) Inventor: Simon Karlik, Cromer (AU)

( * ) Notice: Subject to any disclaimer, the term of this patent is extended or adjusted under 35 U.S.C. 154(b) by 0 days.

(21) Appl. No.: 17/048,159

(22) PCT Filed: Mar. 22, 2019

(86) PCT No.: PCT/AU2019/050254

§ 371 (c)(1),
(2) Date: Oct. 16, 2020

(87) PCT Pub. No.: WO2019/204859

PCT Pub. Date: Oct. 31, 2019

(65) Prior Publication Data

US 2021/0371171 A1 Dec. 2, 2021

(30) Foreign Application Priority Data

Apr. 27, 2018 (AU) ..... 2018901398

(51) Int. Cl.
*B65D 47/20* (2006.01)

(52) U.S. Cl.
CPC ..... *B65D 47/2043* (2013.01); *B65D 2543/00046* (2013.01)

(58) Field of Classification Search
CPC ..... B65D 47/2043; B65D 2543/00046; B65D 25/465; B65D 51/242
See application file for complete search history.

(56) References Cited

U.S. PATENT DOCUMENTS 2,909,305 A * 10/1959 Opsitnik ..... A47J 41/0072 222/466
3,337,098 A * 8/1967 Johns ..... B65D 47/2043 222/505
3,447,724 A * 6/1969 Fiddyment ..... B65D 47/286 222/469
5,150,815 A * 9/1992 Saklad ..... A47G 19/2227 215/12.1
5,259,538 A * 11/1993 Tardif ..... B65D 47/2043 222/528

(Continued)

FOREIGN PATENT DOCUMENTS

DE 19646261 A1 * 3/1998 ..... A47G 19/2266

*Primary Examiner* — Donnell A Long
(74) *Attorney, Agent, or Firm* — Hovey Williams LLP

(57) ABSTRACT

A cap assembly comprises a base portion, a head portion, a fluid conduit, and an engagement member. The base portion is configured for removably coupling to a neck of a fluid compartment of a drinking vessel and includes an aperture in fluid communication with an internal volume of the fluid compartment via an opening at the neck. The head portion is rotatably coupled to the base portion. The fluid conduit is operably coupled between the aperture at the base portion and an outlet at an upper end of the head portion to enable a fluid to flow therebetween. The an engagement member is mounted to the head portion and shaped to engage a compressible portion of the fluid conduit. The head portion is configured to rotate about a longitudinal axis relative to the base portion in a first direction and in a second direction, opposite to the first direction.

16 Claims, 13 Drawing Sheets

(56) References Cited

U.S. PATENT DOCUMENTS 5,273,172 A * 12/1993 Rossbach ..... B65D 47/2043 215/229
5,361,934 A * 11/1994 Spence, Jr. ..... A47G 19/2266 215/388
5,518,142 A * 5/1996 Lin ..... A47G 19/2211 215/389
6,050,433 A * 4/2000 Russell ..... B65D 47/2043 215/229
6,523,711 B1 * 2/2003 Hughes ..... A47G 19/2266 215/308
7,124,907 B2 * 10/2006 Conaway ..... A47G 19/2266 220/254.1
8,757,446 B1 * 6/2014 Liu ..... B05B 9/043 222/153.04
2004/0069783 A1 * 4/2004 Chen ..... A47G 19/2266 220/254.3
2006/0226110 A1 * 10/2006 Choi ..... A45F 3/20 215/228
2007/0187436 A1 * 8/2007 Oran ..... B65D 83/303 222/530
2009/0255944 A1 * 10/2009 Yamashita ..... A47G 19/2266 220/705
2010/0170902 A1 * 7/2010 Britto ..... B65D 47/066 220/367.1
2011/0049169 A1 * 3/2011 Rosnak ..... B65D 47/06 220/705
2011/0062170 A1 * 3/2011 Kemper ..... A47G 19/2266 220/708
2012/0160851 A1 * 6/2012 Chiang ..... B65D 47/268 220/360
2012/0187075 A1 * 7/2012 El-Saden ..... B65D 51/242 215/389
2013/0068854 A1 * 3/2013 Miracle ..... A47G 21/18 239/33
2013/0175270 A1 * 7/2013 Fujita ..... A47G 19/2266 220/203.01
2014/0069944 A1 * 3/2014 Shapiro ..... A47G 19/2272 220/709
2015/0305528 A1 * 10/2015 Chen ..... A47G 19/2266 220/666
2016/0000245 A1 * 1/2016 Sims ..... B65D 43/0225 220/253
2016/0130047 A1 * 5/2016 Koenigseder ..... B65D 47/0804 222/556
2017/0043916 A1 * 2/2017 Seiders ..... B65D 41/04
2019/0075950 A1 * 3/2019 Xu ..... A47G 19/2266
2019/0144173 A1 * 5/2019 Fu ..... B65D 43/0225 222/1
2019/0290037 A1 * 9/2019 Wiesman ..... B65D 47/066
2019/0367224 A1 * 12/2019 Campbell ..... A47G 19/2266
2020/0170426 A1 * 6/2020 Michaels ..... B65D 47/066
2021/0085106 A1 * 3/2021 Amatoury ..... F16K 7/12
2021/0086963 A1 * 3/2021 Siegenthaler ..... B65D 47/2062

* cited by examiner

VARIABLE FLOW CAP ASSEMBLY FOR A DRINKING VESSEL

TECHNICAL FIELD

The present invention relates to a cap assembly for a drinking vessel, and in particular to a cap assembly with variable flow capability to facilitate a flow of fluid from the drinking vessel to an outlet in the cap assembly in a controllable manner.

The invention has been developed primarily for use with beverages and will be described hereinafter with reference to this application.

The following discussion of the background to the invention is intended to facilitate an understanding of the invention. However, it should be appreciated that the discussion is not an acknowledgement or admission that any of the material referred to was published, known or part of the common general knowledge in Australia or any other country as at the priority date of any one of the claims of this specification.

BACKGROUND OF INVENTION

Despite drinking receptacles or vessels being numerous in number, one common feature that unites them all is that the means by which a fluid contained within the drinking vessel is communicated to an outlet for drinking the fluid therefrom, is limited by the dimensions of the fluid passageway along which the fluid flows. This means that a young child drinking from one vessel will receive the same volume of fluid as an adult would when drinking from the same vessel, and at the same flow speed, depending on the angle at which the drinking vessel is raised. Similarly, a person or athlete having engaged in strenuous activity is unlikely to have their thirst satisfactorily quenched by drinking from a vessel that is configured for general everyday use.

The present invention seeks to provide a variable flow cap assembly for a drinking vessel, which will overcome or substantially ameliorate at least some of the deficiencies of the prior art, or to at least provide an alternative.

SUMMARY OF INVENTION

According to a first aspect of the present invention there is provided a cap assembly, including:

a base portion configured for removably coupling to a neck of a fluid compartment and including an aperture in fluid communication with an internal volume of the fluid compartment of a drinking vessel via an opening at the neck;

a head portion rotatably coupled to the base portion;

a fluid conduit operably coupled between the aperture at the base portion and an outlet at an upper end of the head portion to enable a fluid to flow therebetween; and an engagement member mounted to the head portion and shaped to engage a compressible portion of the fluid conduit, wherein the head portion is configured to rotate relative to the base portion according to a first direction, in which the engagement member is caused to rotate and apply a pressure to the compressible portion of the fluid conduit to reduce a flow of fluid from the internal volume of the fluid compartment to the outlet, and according to a second direction that is opposite to the first direction, in which the engagement member is caused to rotate and release the pressure on the compressible portion of the fluid conduit to increase the flow of fluid from the internal volume of the fluid compartment to the outlet.

In one embodiment, the head portion rotates relative to the base portion between a plurality of predetermined flow positions, wherein each flow position corresponds to a predetermined degree of pressure applied to the compressible portion of the fluid conduit by the engagement member to alter the bore size of the compressible portion.

In one embodiment, when the head portion is rotated relative to the base portion to a first predetermined flow position, the degree of pressure applied to the compressible portion by the engagement member is insufficient to reduce the bore size of the compressible portion, thereby defining a FULL-FLOW position.

In one embodiment, when the head portion is rotated relative to the base portion to a third predetermined flow position, the degree of pressure applied to the compressible portion by the engagement member is sufficient to reduce the bore size of the compressible portion completely, thereby defining a CLOSED position.

In one embodiment, when the head portion is rotated relative to the base portion to a second predetermined flow position intermediate of the first and third predetermined flow positions, the degree of pressure applied to the compressible portion by the engagement member is less than the pressure applied to the compressible portion in respect of the CLOSED position, but greater than the pressure applied to the compressible portion in respect of the FULL-FLOW position such that the compressible portion has a bore size that is intermediate of the bore sizes corresponding to the CLOSED position and the FULL-FLOW position, thereby defining a MID-FLOW position.

In one embodiment, the engagement member includes a generally semi-circular body having a straight-edged portion oriented to engage the compressible portion of the fluid conduit in at least one of the plurality of predetermined positions and a semi-circular portion including mounting means located distal to the straight-edged portion for mounting the engagement member to the head portion.

Suitably, the body of the engagement member includes an aperture that extends substantially therethrough and the base portion includes a rotation mount upstanding from the body for rotatably mounting the engagement member to the rotation mount via the aperture.

In one embodiment, the base portion includes at least one arcuate groove configured with one or more indents disposed along an internal surface of the arcuate groove in spaced apart arrangement, and the head portion includes at least one projection depending from a lower surface thereof, the projection configured to locate at least partially within the arcuate groove and engage with the one or more indents to provide a positive indication that the head portion has been rotated to a selected one of the plurality of predetermined flow positions when the projection engages a corresponding one of the indents disposed along the internal surface of the arcuate groove.

Preferably, the base portion further includes a plurality of indicators located on an external surface thereof, each indicator corresponding to one of the plurality of predetermined flow positions.

In one embodiment, the base portion is removably coupled to the neck of the fluid compartment by screw threaded engagement.

In one embodiment, at least one of the head portion and the base portion is manufactured from an engineering plastic.

In one embodiment, the engineering plastic is plasticizer-free.

In one embodiment, the cap assembly further includes a cover for covering the outlet when not in use.

Preferably, the cover is pivotably coupled to the head portion.

In one embodiment, at least the compressible portion of the fluid conduit is manufactured from silicone rubber.

In one embodiment, the cap assembly further includes a handle pivotably coupled to the head portion.

According to a second aspect of the present invention there is provided a drinking vessel, including:

a fluid compartment having a neck with an opening and an internal volume sized to contain a fluid; and a cap assembly according to the first aspect removably coupled to the neck of the fluid compartment.

Other aspects of the invention are also disclosed.

BRIEF DESCRIPTION OF DRAWINGS

Notwithstanding any other forms which may fall within the scope of the present invention, preferred embodiments of the invention will now be described, by way of example only, with reference to the accompanying drawings in which.

DETAILED DESCRIPTION

It is to be understood that the following description is for the purpose of describing particular embodiments only and is not intended to be limiting with respect to the above description.

The present invention is predicated on the finding of a cap assembly 10 for a drinking vessel 200 in which the cap assembly 10 has a variable flow capability to enable a user of the drinking vessel 200 the means by which to selectively control the amount of fluid that flows from a fluid compartment 210 of the drinking vessel 200 to an outlet 26A from which to drink when the drinking vessel 200 is sufficiently elevated to a drinking position to allow said fluid to flow under gravity.

Cap Assembly

Figure 1:
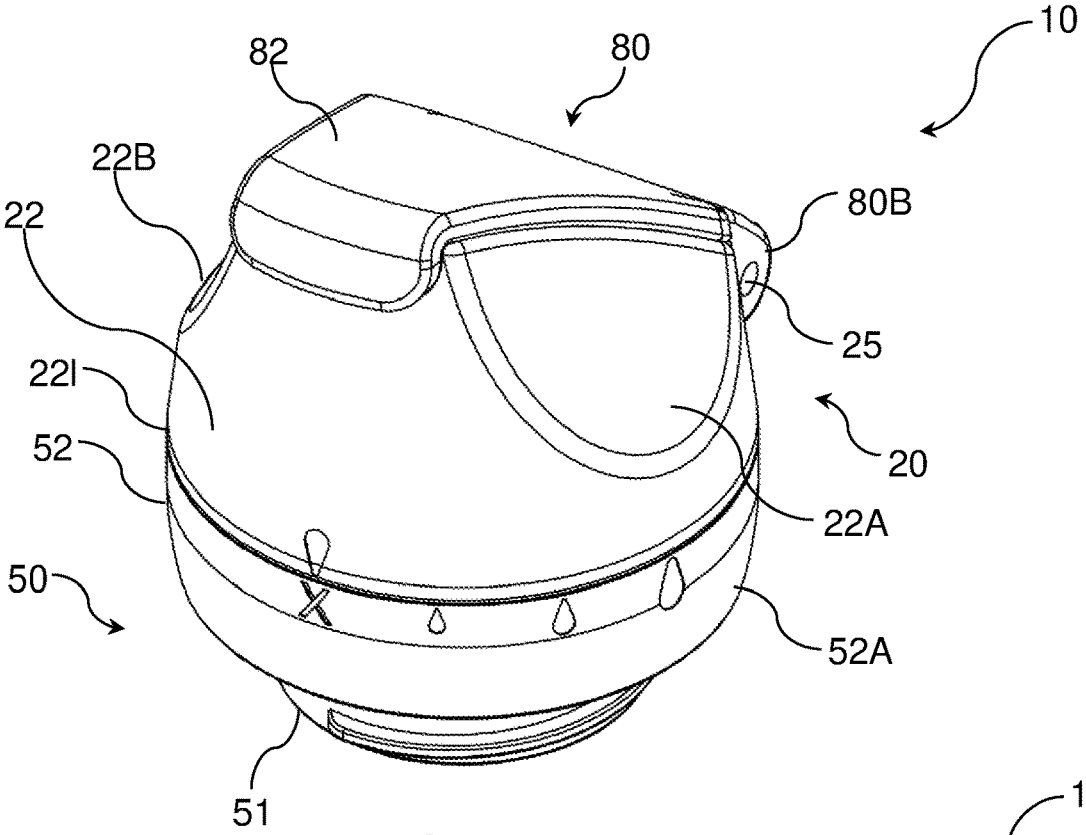
FIGS. 1 to 3 show various views of a cap assembly for removably coupling to a fluid compartment of a drinking vessel according to a preferred embodiment of the present invention.
Figure 2:
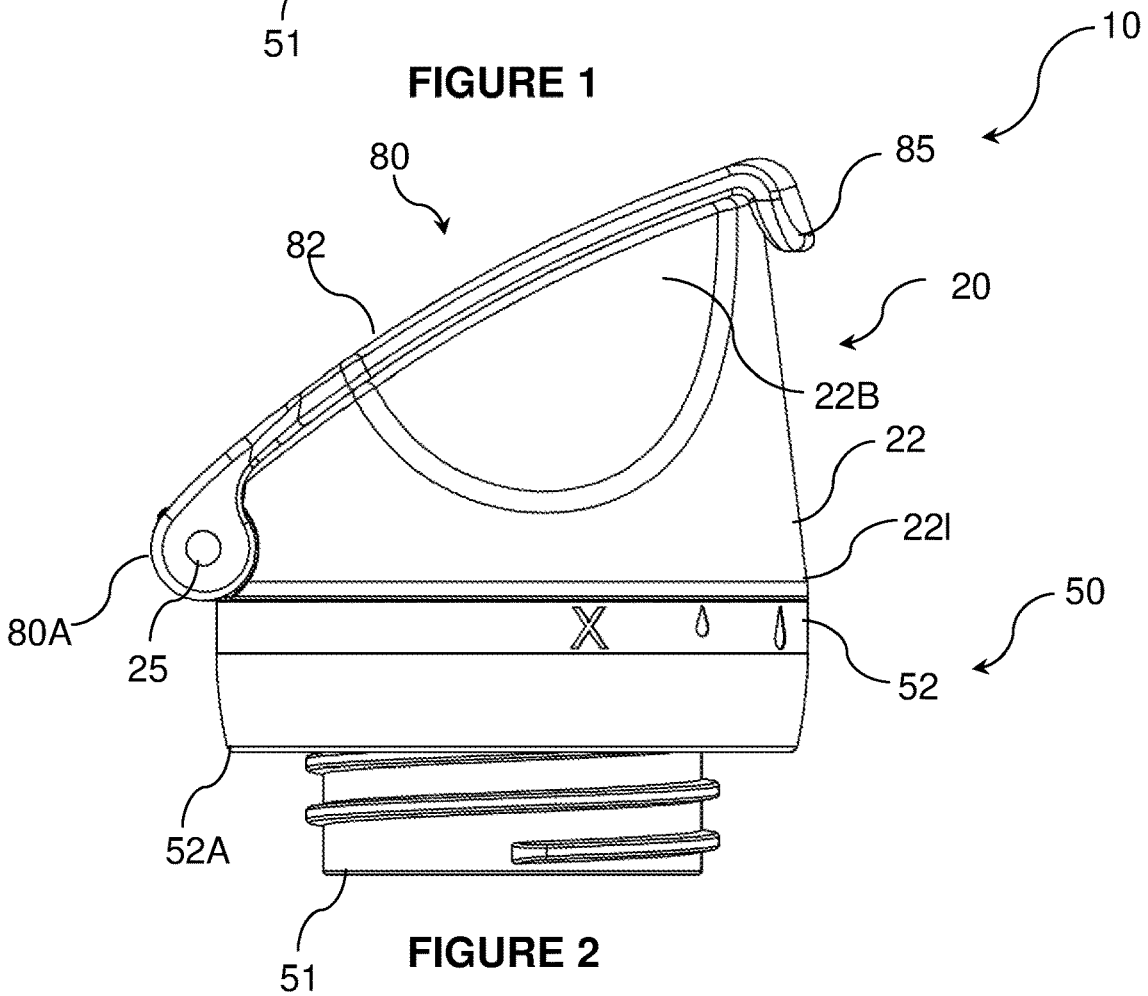
Figure 3:
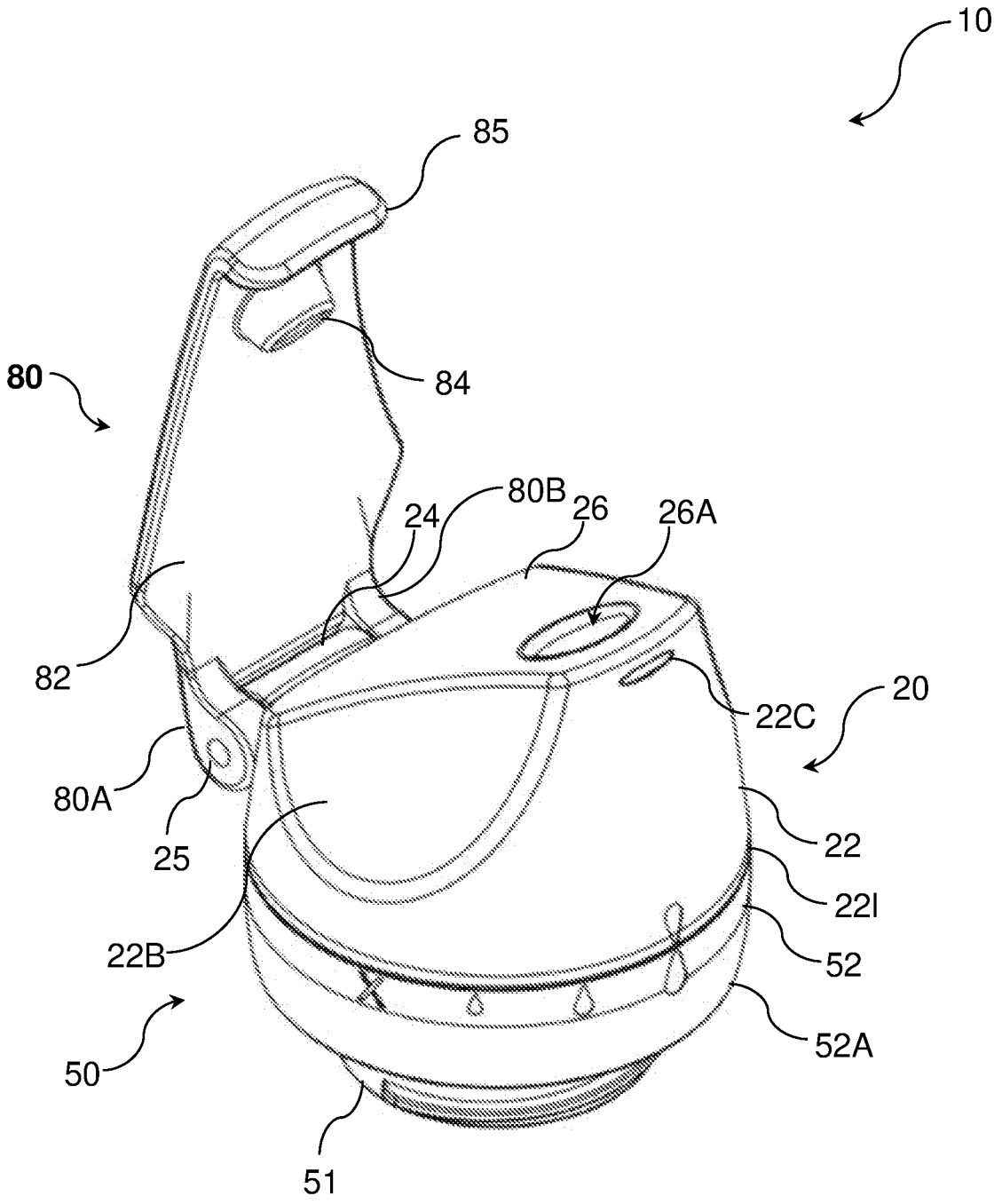
Figure 4:
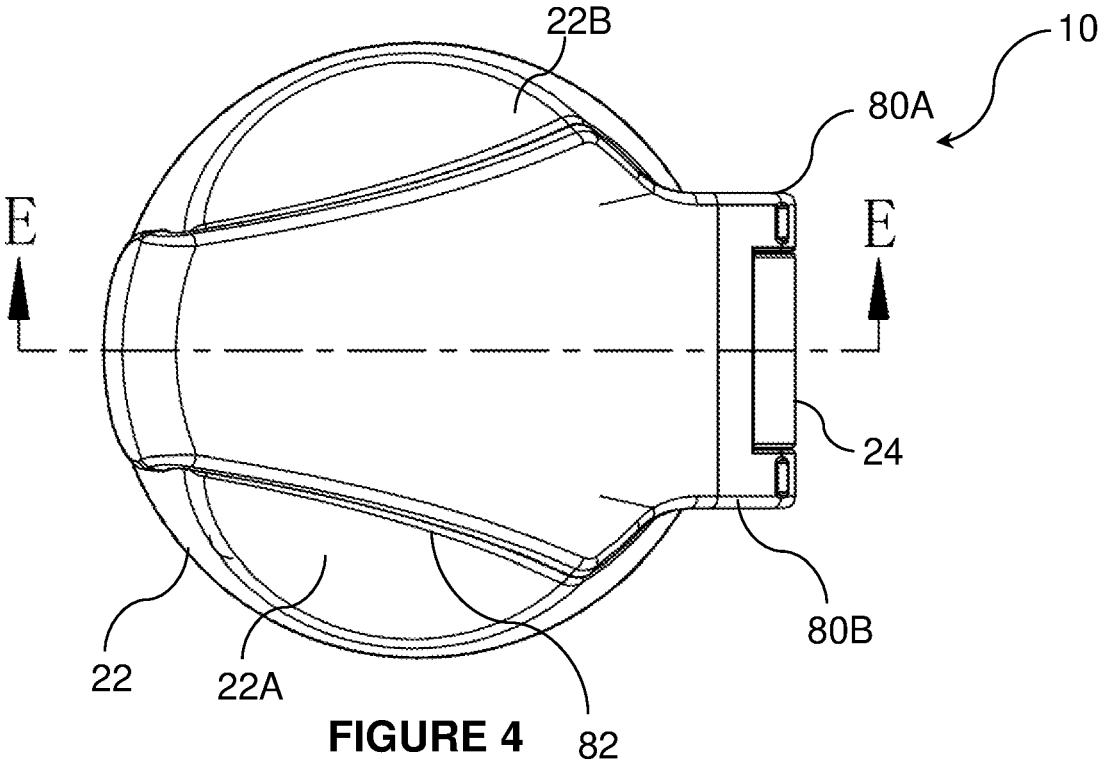
FIG. 4 shows a plan view of the cap assembly of FIGS. 1 to 3.

FIGS. 1 to 3 show several perspective views of a cap assembly 10 according to a preferred embodiment of the present invention.

Figure 7:
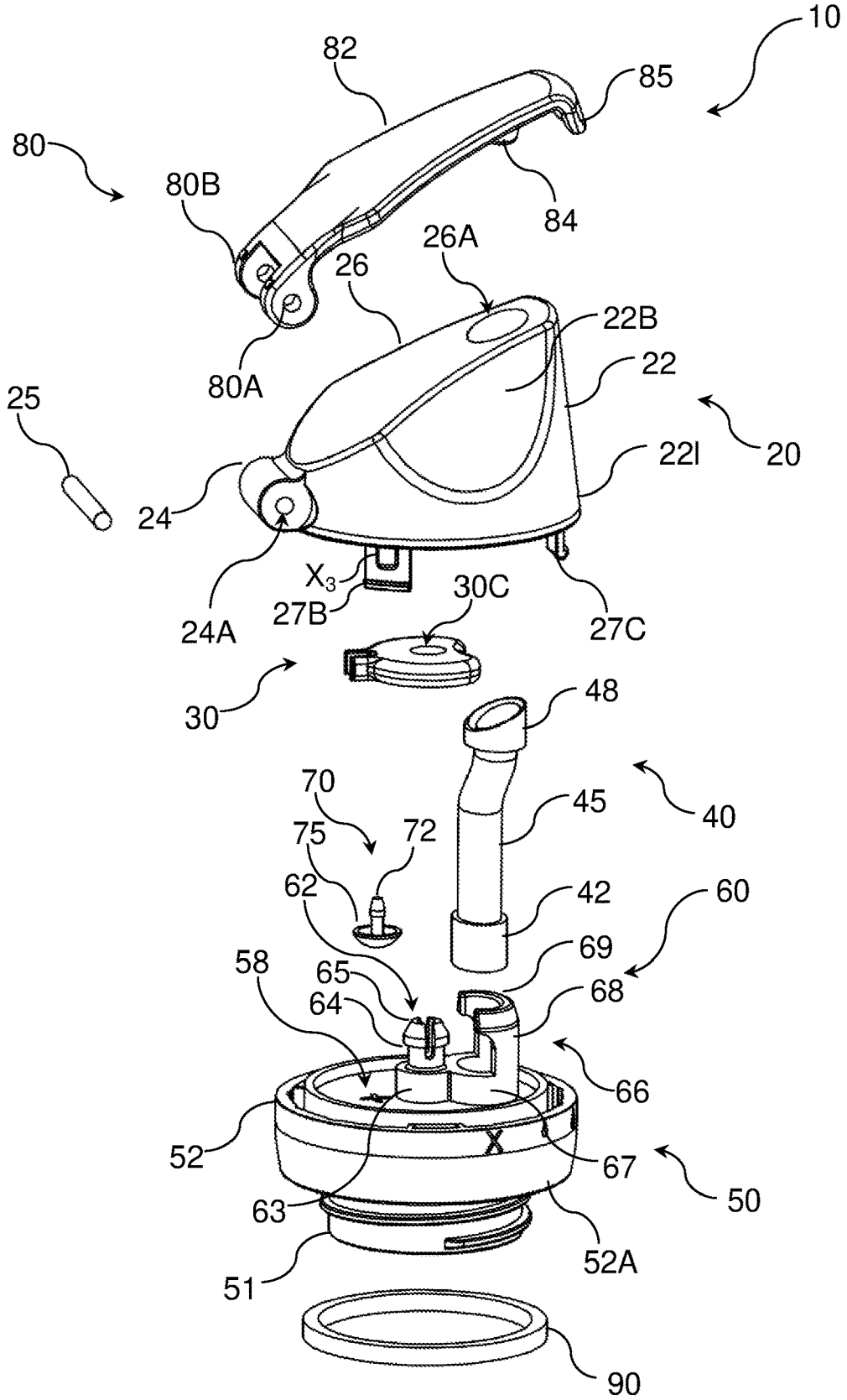
FIG. 7 shows an exploded view of the cap assembly of FIGS. 1 to 3.
Figure 16:
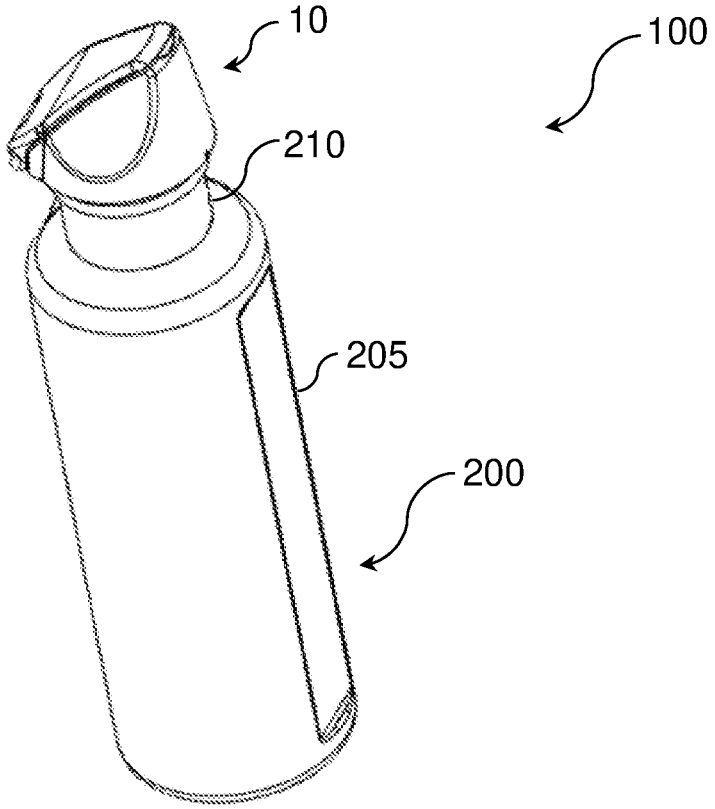
FIG. 16 shows a perspective view of the cap assembly of FIGS. 1 to 3 operably coupled to a neck of a fluid compartment of a drinking vessel.
Figure 17:
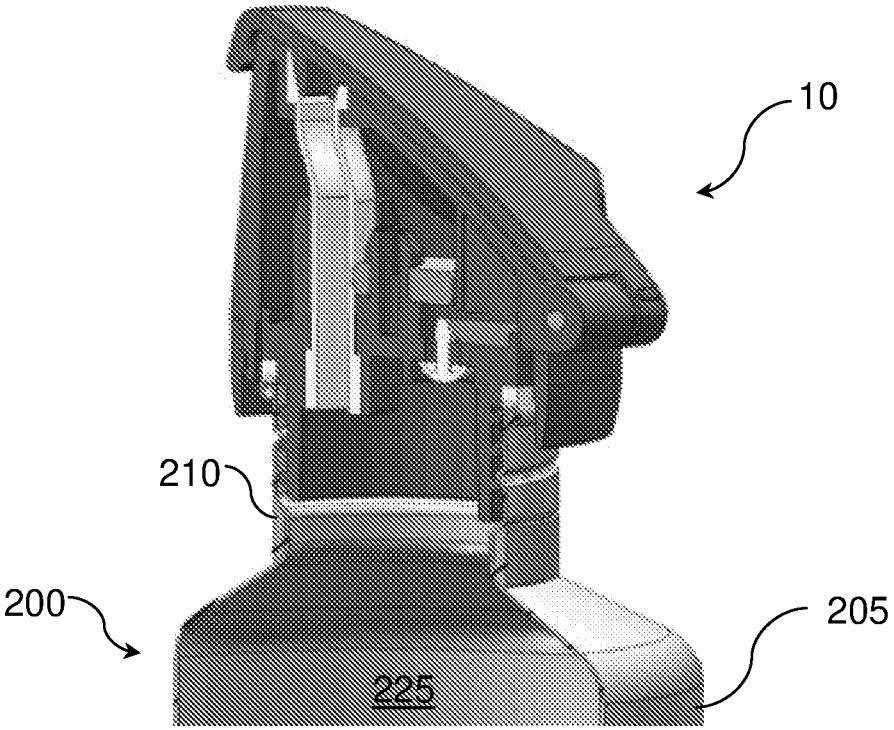
FIG. 17 shows a cross sectional view of the cap assembly of FIGS. 1 to 3 operably coupled to the neck of the fluid compartment (shown in partial view) of the drinking vessel shown in FIG. 16.

As shown in these figures, and in the exploded view in FIG. 7, the cap assembly 10 includes a base portion 50 configured for removably coupling to a neck 210 of a fluid compartment 205 of a drinking vessel 200, such as that shown in, for example, FIGS. 16 and 17, and a head portion 20 rotatably coupled to the base portion 50.

The structure of the cap assembly 10 will now be described in more detail with reference to the corresponding figures.

Head Portion

As shown in FIGS. 1 to 3, and more specifically in FIGS. 8 to 11, the head portion 20 includes a hollow housing 22 shaped to define a generally truncated cone like structure with a sloping upper portion 26 that defines the truncated part of the cone. The housing 22 includes two chamfered portions 22A, 22B that slope downwardly from laterally opposing side edges of the sloping upper portion 26 to a generally circular lower portion 221 of the housing 22.

The housing 22 includes an aperture 26A located at the top of the sloping upper portion 26, which extends substantially through the upper portion 26 into the cavity of the housing 22 to define an outlet from which a user may drink fluid from when the drinking vessel is assembled. Located at a front surface of the housing 22 just below the aperture 26A is a small indent 22C, the purpose of which will also be described in more detail below.

Extending outwardly from a rear portion of the housing 22 just below a lower end of the sloping upper portion 26 is a horizontally mounted hinge bracket 24 with an aperture 24A that extends substantially through the hinge bracket 24 that is sized to receive a spindle 25 substantially therethrough.

As shown in FIGS. 8 to 11, the generally circular lower portion 221 of the cone shaped housing 22 includes three hook shaped members 27A, 27B, 27C depending from a bottom surface 22D of the lower portion 221 of the housing 22 in spaced apart arrangement. Each of the three hook shaped members 27A, 27B, 27C has a generally arcuate shape that corresponds to the curvature of the lower portion 221 of the housing 22, and a hook shaped portion at a terminal thereof that extends outwardly away from a centre of the housing 22. The outwardly facing surface of each of the three hook shaped members 27A, 27B, 27C also includes a small generally semi-cylindrical projection extending outwardly therefrom, the purpose of which will be described in more detail later on.

Figure 8:
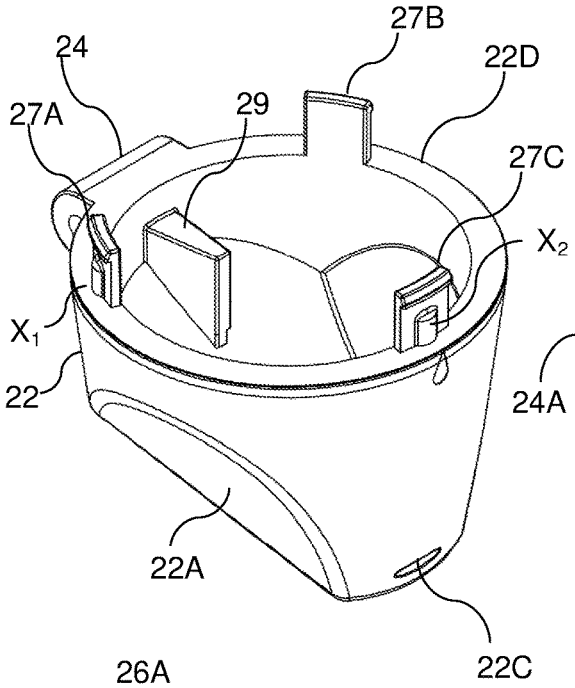
FIGS. 8 to 11 show various perspective views of a head portion of the cap assembly of FIGS. 1 to 3.
Figure 9:
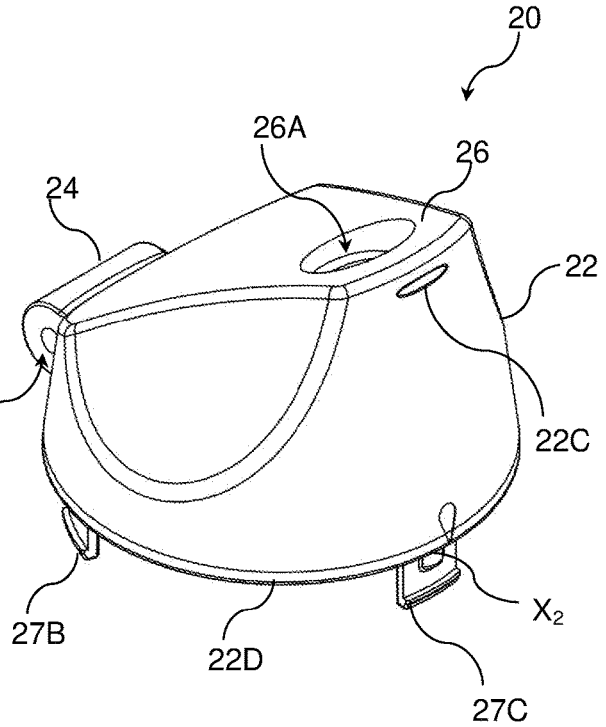
Figure 10:
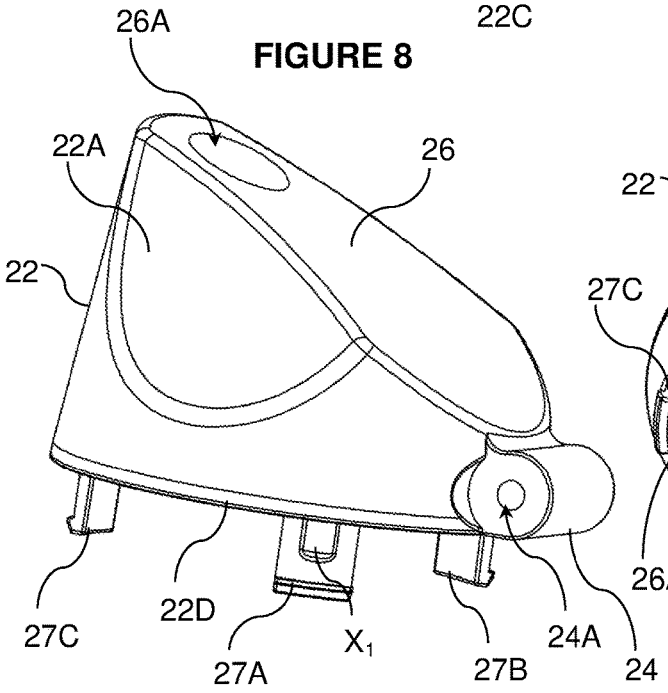
Figure 11:
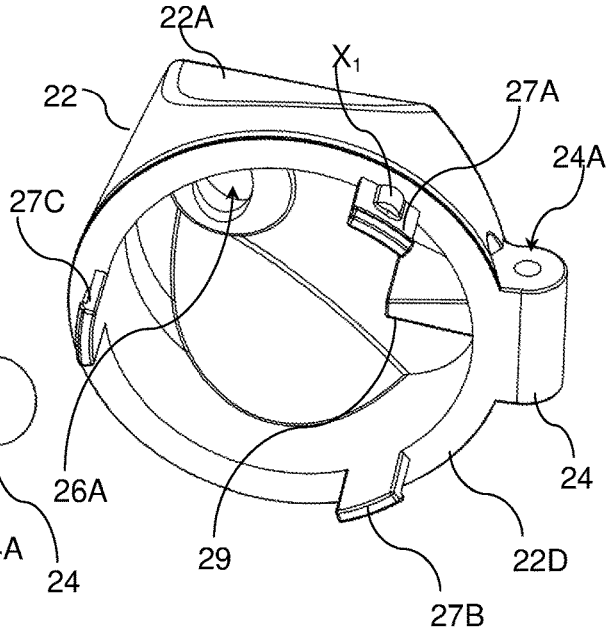

As shown in FIGS. 7 to 11, and more specifically in FIGS. 8 and 11, the housing 22 includes a generally triangular shaped prismatic mount 29 located within the cavity of the housing 22 at the rear portion thereof. This mount 29 is integral with both an underside of the sloping upper portion 26 and an inner surface of the generally circular lower portion 221 of the housing 22, and extends downwardly from the underside of the sloping upper portion 26 to a point generally midway along the height of the generally circular lower portion 221 of the housing 22. The purpose of the mount 29 will be described in more detail below.

As shown in FIG. 7, the cap assembly 10 further includes an engagement member 30 that is shaped for use in engaging and applying a pressure to a compressible portion 45 of a fluid conduit 40 extending through the base portion 50. The engagement member 30 includes a generally semi-circular body having a straight-edged portion and mounting means located distal to the straight-edged portion for mounting the engagement member 30 to the head portion 20.

FIGS. 18 to 21 show various views of the cap assembly 10 in which an upper portion of the housing 22 of the head portion 20 has been removed for clarity, revealing only the lower portion 221 of the housing 22 mounted to the base portion 50 of the cap assembly 10. Specifically, the lower portion 221 of the housing 22 corresponds to the generally circular part of the housing 22 that includes the hinge bracket 24 and a small portion of the mount 29 that extends inwardly from the inner surface of the lower portion 221 of the housing 22, the purpose of which will now be described.

As is shown in FIGS. 18 to 21, the generally semi-circular shaped body of the engagement member 30 is mounted to an innermost facing end portion of the mount 29 by way of the mounting means which comes in the form of a pair of laterally spaced apart arms 30A, 30B that extend from a rear portion of the engagement member 30 and which locate either side of the innermost facing end of the mount 29, secured thereto by way of a suitable attachment means, such as an adhesive or mechanical fastener. Extending substantially through the body of the engagement member 30 from an upper surface to a lower surface thereof is an aperture 30C, the purpose of which will become clear from the description below.

Cover

As shown in FIGS. 1 to 4, the cap assembly 10 further includes a cover 80 for use in covering the fluid outlet (that is, the aperture 26A) when the drinking vessel is not in use. Specifically, the cover 80 is of a generally plate like configuration and includes a main portion 82 which is shaped to conform to the outline and contour of the upper sloping portion 26 of the housing 22.

Extending outwardly from a lower end of the main portion 82 of the cover 80 is a pair of hinge arms 80A, 80B that are spaced apart by a distance that enables them to locate either side of the hinge bracket 24 at the rear portion of the housing 22 when the cover 80 is mounted to the housing 22. The two hinge arms 80A, 80B each include an aperture that extends substantially through the arms 80A, 80B, and each aperture is sized to receive the same spindle 25 substantially therethrough when the apertures through the two arms 80A, 80B and the aperture 24A through the hinge bracket 24 are substantially aligned. By virtue of this arrangement, the cover 80 is pivotably coupled to the head portion 20, and thus configured to pivot about this pivot point between an open configuration in which an inner surface of the main portion 82 of the cover 80 is flush against the upper sloping portion 26 of the housing 22, and a closed configuration in which the main portion of the cover 80 is pivoted away from the upper sloping portion 26 to expose said sloping portion 26.

Extending downwardly from the inner surface of the main portion 82 of the cover 80 is a protrusion 84 that is shaped to conform to the aperture 26A in the upper sloping portion 26 of the housing 22. The protrusion 82 is positioned at an upper end of the main portion of the cover 80 such that when the cover 80 is in the closed configuration, the protrusion 84 can be received snugly within the aperture 26A to realise a watertight seal.

Extending outwardly from the upper end of the main portion 82 of the cover 80 is a lip portion 85 that is shaped to extend over the end of the upper sloping portion 26 and part way down the front surface of the housing 22 such that the lip portion 85 overlaps the small indent 22C. As shown in the cross-sectional view in FIG. 5, the lip portion 85 includes a small hook member 85A on its inner surface that is configured to locate within the indent 22C when the cover 80 is in the closed configuration. It will be appreciated by persons of ordinary skill in the relevant art that the indent 22C is a just shallow indent, such that the manual force required to overcome the coupling between the hook 85A and the indent 22C when transitioning the cover 80 from the closed configuration to the open configuration is minimal.

Base Portion

As shown in FIG. 7 and FIGS. 12 to 15, the base portion 50 includes a generally circular body 52 of a diameter that corresponds to the diameter of the lower portion 221 of the housing 22, and a skirt portion 52A that extends downwardly from a periphery of the circular body 52 where it terminates at a lower edge.

The base portion 50 further includes a generally circular coupling portion 51 that extends downwardly from an underside of the body 52 to a point below the lower edge of the skirt portion 52A, but which has a diameter that is smaller than the diameter of the circular body 52, and so defines a spacing between an external surface of the coupling portion 51 and an internal surface of the skirt portion 52A.

The coupling portion 51 includes a threaded portion disposed about its external surface that is complementary to an internally thread portion that lines the inner surface of the neck 210 of the fluid compartment 210 to allow the cap assembly 10 to be removably coupled to the neck 210 of the fluid compartment 210 by screw threaded engagement to realise the drinking vessel 200 shown in FIG. 16 and in the partial cross sectional view in FIG. 17.

Figure 12:
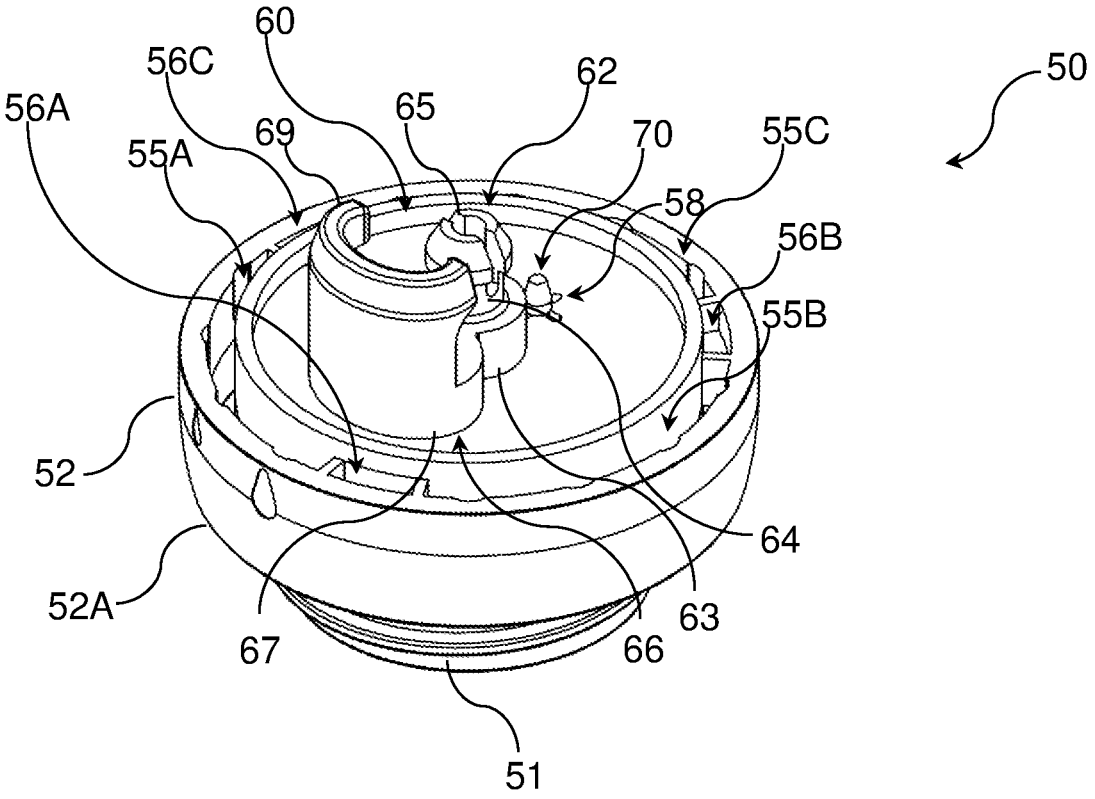
FIG. 12 shows a perspective view of a base portion of the cap assembly of FIGS. 1 to 3.
Figure 13:
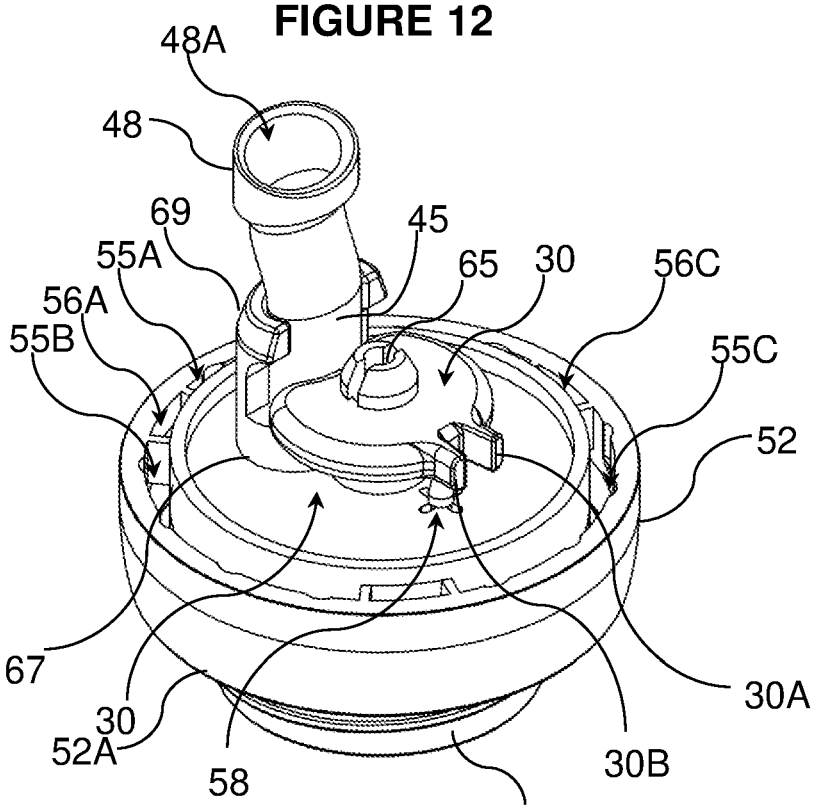
FIGS. 13 to 15 show perspective views of the base portion of FIG. 12 in combination with a fluid conduit and an engagement member mounted to the base portion at their respective positions.
Figure 14:
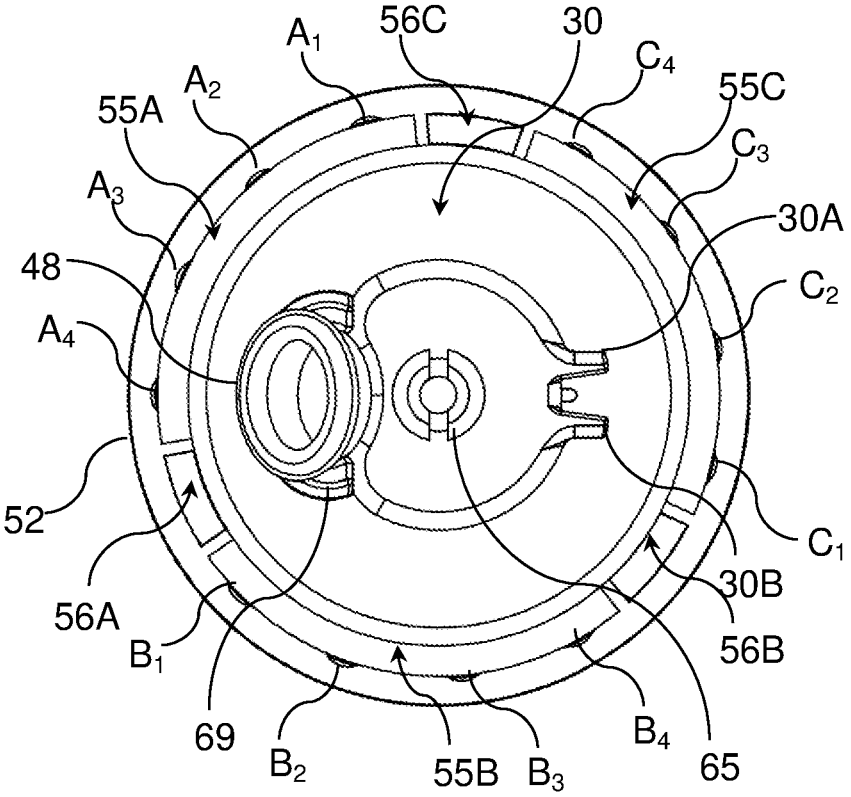

As shown in FIGS. 12 to 14, the circular body 52 includes a non-continuous groove that extends around the circular body 52, a short distance inwards from the peripheral edge thereof. Specifically, the groove is divided into three arcuate grooves 55A, 55B, 55C and three smaller arcuate grooves 56A, 56B, 56C, in which each one of the smaller arcuate grooves 56A, 56B, 56C is located between a corresponding pair of the longer arcuate grooves 55A, 55B, 55C. The three longer arcuate grooves 55A, 55B, 55C are configured to receive a corresponding one of the three hook shaped members 27A, 27B, 27C that depend from the bottom surface 22D of the housing 22 when the head portion 20 is mounted to the base portion 50.

As is apparent from the cross-sectional side view of the cap assembly 10 shown in FIG. 5, the hook shaped portion at the terminal outer facing end of each member 27A, 27B, 27C locates below an inwardly facing ridge 52Ar formed on an inner surface of the skirt portion 52A, thereby locking the housing 22 of the head portion 20 to the base portion 50.

As shown in FIGS. 12 to 13, and more specifically in FIG. 14, the three longer arcuate grooves 55A, 55B, 55C each include four generally semi-cylindrical indents $Y_1$, $Y_2$, $Y_3$, $Y_4$ (where Y refers to A, B or C depending on the arcuate groove 55A, 55B, 55C) disposed in a vertical orientation within the outwardly facing surface of the corresponding arcuate groove 55A, 55B, 55C in spaced apart arrangement. The indents $Y_1$, $Y_2$, $Y_3$, $Y_4$ have a configuration that is complementary to that of the generally semi-cylindrical projection $X_1$, $X_2$, $X_3$ protruding from the outwardly facing surface of the corresponding three hook shaped member 27A, 27B, 27C.

By virtue of this arrangement, it will be appreciated that as the head portion 20 is rotated relative to the base portion 50, the three hook shaped members 27A, 27B, 27C located within a corresponding arcuate groove 55A, 55B, 55C will rotate with the head portion 20 and the user will experience a small vibration or click when the semi-cylindrical projection $X_1$, $X_2$, $X_3$ on each hook shaped member 27A, 27B, 27C is received within a corresponding one of the semi-cylindrical indents $Y_1$, $Y_2$, $Y_3$, $Y_4$ associated with the arcuate groove 55A, 55B, 55C within which the hook shaped member 27A, 27B, 27C is located. This vibration or click provides the user with a positive indication that the head portion 20 has been rotated to a predetermined flow position that dictates a volume of flow that can flow from the internal volume 225 of the fluid compartment 205 to the outlet 26A, which is associated with that particular flow position.

That is, the arrangement provides a positive indication that informs the user that the head portion 20 has been rotated to a selected one of the plurality of predetermined flow positions when the projections $X_1$, $X_2$, $X_3$ engage a corresponding one of the indents $Y_1$, $Y_2$, $Y_3$, $Y_4$ disposed along the internal surface of the corresponding arcuate groove 55A, 55B, 55C.

Similarly, when the head portion 20 is rotated further, the projections $X_1$, $X_2$, $X_3$ are caused to exit the corresponding indents $Y_1$, $Y_2$, $Y_3$, $Y_4$ from which they are located, and move to a position in the arcuate groove 55A, 55B, 55C that is slightly narrower than the position at the indent $Y_1$, $Y_2$, $Y_3$, $Y_4$, thereby providing a small degree of resistance to rotation. This arrangement provides a positive indication that informs the user that the head portion 20 has been rotated to a position that is between two predetermined flow positions of fluid flow.

Indicators

To provide the user with a visible indication of which predetermined flow position is in use, the base portion 50 further includes four indicators A, B, C, D located at an external surface of the skirt portion 52A. Additionally, the housing 22 of the head portion 20 includes a single selector indicator S located at the lower portion 221 of the housing 22. Each indicator A, B, C, D corresponds to one of four predetermined flow positions that are defined by the position of the head portion 20 rotated about the longitudinal axis relative to the base portion 50, and thus correlates with a corresponding one of the four semi-cylindrical indents $Y_1$, $Y_2$, $Y_3$, $Y_4$ disposed along the length of each of the three arcuate grooves 55A, 55B, 55C. Thus, as the head portion 20 is rotated about the longitudinal axis, the selector indicator S aligns with each of the four indicators A, B, C, D in turn to provide the user with a positive indication of the predetermined flow position.

As shown in, for example, FIGS. 1 to 3, the indicators A, B, C, D are configured as indicia on the external surface of the skirt portion 52A of the body 52. The first indicator A is shown as an "X", while the three remaining indicators B, C and D are represented as "water drops" of increasing size. The selector indicator S is similarly configured as an indicia representing a "water drop" on the external surface of the lower portion 221 of the housing 22. This particular arrangement provides a visual means by which to represent the rotational position of the head portion 20 relative to the base portion 50.

It will be appreciated by those skilled in the relevant art that indicators A, B, C, D and S may be represented by any one of a number of means to represent the degree of rotation of the head portion 20 about the longitudinal axis relative to the base portion 50. For instance, indicators A, B, C, D and S may be represented by indentations, raised portions, visual indicia, or any combination thereof to provide a visual and/or tactile indication of the predetermined flow positions.

Figure 15:
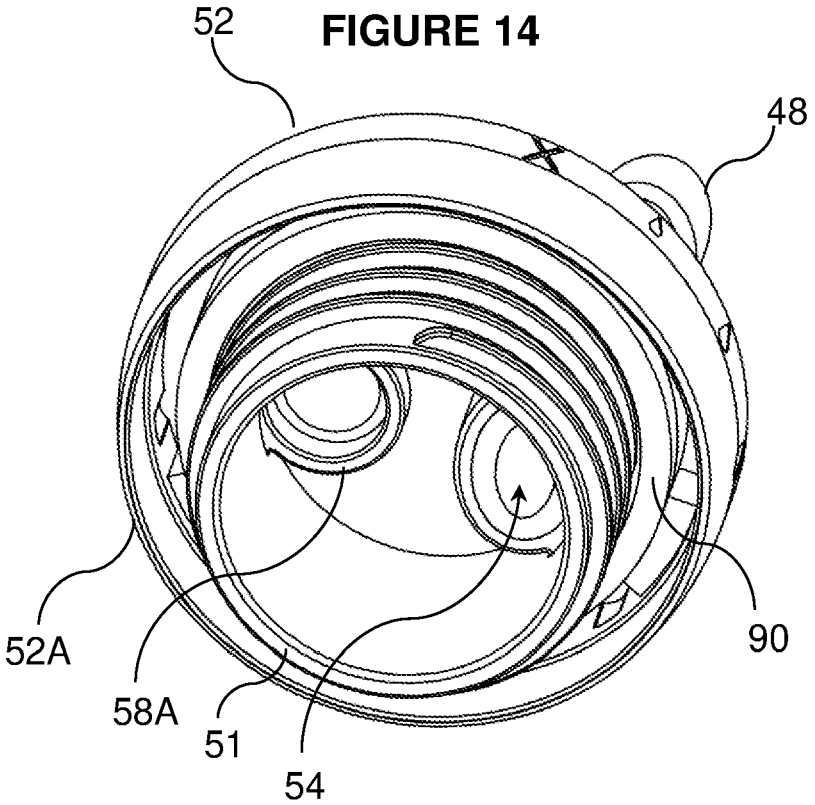

As shown in FIG. 15, the circular body 52 includes an aperture 54 that extends substantially through the body 52 from the upper surface to the lower surface thereof. The aperture 54 is positioned offset from the centre of the body 52, but is still located within the boundary defined by the coupling portion 51, such that when the cap assembly 10 is coupled to the neck 210 of the fluid compartment 205 via the coupling portion 51, the aperture 54 is in fluid communication with the opening of the neck 210 and subsequently the internal volume 225 of the fluid compartment 205.

As shown in FIGS. 7 and 12, the circular body 52 includes a structure 60 upstanding from the upper surface of the body 52. The structure 60 is a combination of two conjoined structures, namely, a rotation mount 62 located at the centre of the circular body 52 and a support structure 66 located offset from the centre of the circular body 52, each of which serves a different purpose. The rotation mount 62 is configured to rotatably mount the engagement member 30 when the head portion 20 is mounted to the base portion 50 and the support structure 66 is configured to support a fluid conduit 40 that extends through the body of the base portion 50.

As shown in FIG. 7 and FIGS. 12 to 14, the rotation mount 62 includes a generally circular base portion 63, a mid-portion 64 having a smaller diameter to the base portion 63, and an upper portion 65 that has a generally cone like configuration with a diameter at its base that is greater than the diameter of the mid-portion 64, but less than the diameter of the base portion 63.

As can be seen in FIG. 7, the upper portion 65 and part of the mid-portion 64 are divided into two half portions with a spacing therebetween. The rotation mount 62 is manufactured from a suitably flexible material to allow the two half portions of the upper portion 65 to be forced together when mounting the engagement member 30 to the rotation mount 62 via aperture 30C. Once the aperture 30C has been forced passed the upper portion 65, the two half portions are then able to return to their original positions of rest and the engagement member 30 is considered to be rotatably mounted at the mid-portion 64 of the rotation mount 62.

As shown in FIG. 7 and FIGS. 12 to 14, the support structure 66 is positioned offset from the centre of the circular body 52 so as to be substantially aligned with the aperture 54. The support structure 66 is defined by a wall that follows the perimeter of the aperture 54 to define a generally tubular base portion 67. The wall of the support structure 66 extends upwardly from only an outwardly facing part of the base portion 67 to define a generally arcuate shaped mid-portion 68, before finally terminating at an upper portion 69 that has a slightly longer arc than that of the mid-portion 68.

As shown in FIG. 7, the circular body 52 also includes an aperture 58 that extends substantially through the body 52 from the upper surface to the lower surface. The aperture 58 is positioned offset from the centre of the body 52, but is still located within the boundary defined by the coupling portion 51. When viewed from the top down (see FIGS. 7 and 13), the aperture 58 appears in the upper surface with four short arms that extend out from the aperture 58 to give the appearance of a "cross hair", while when viewed from beneath (see FIG. 15), the aperture 58 appears at the lower surface as a circular aperture 58A.

Figure 5:
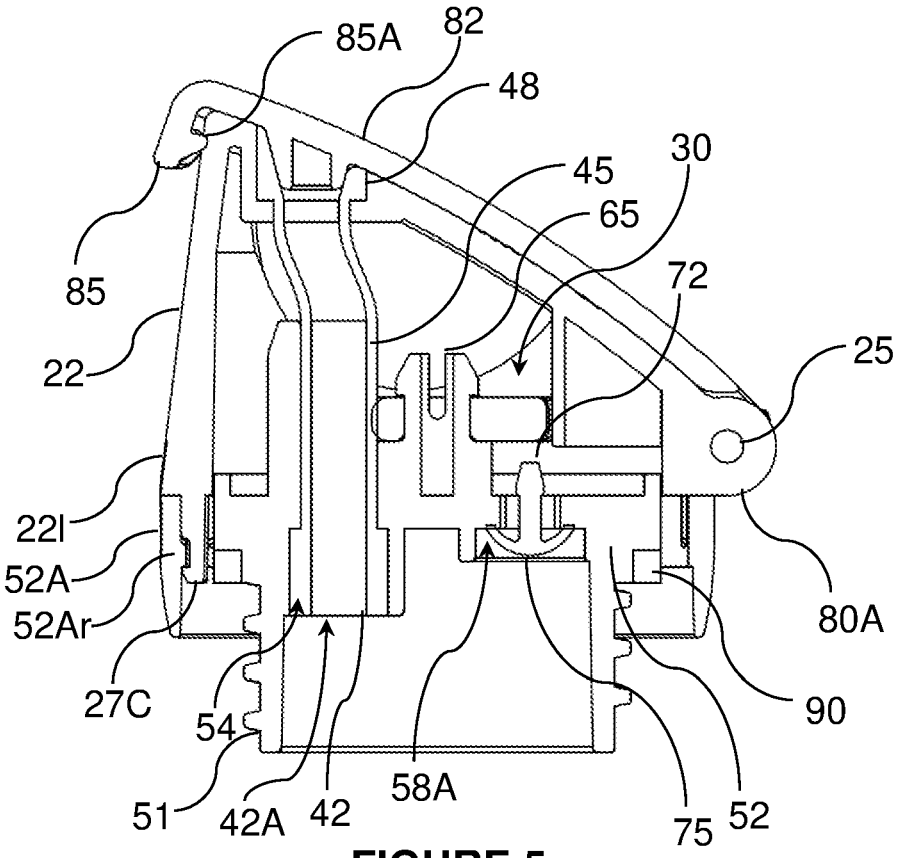
FIG. 5 shows a sectional side view of the cap assembly of FIG. 4 taken along E-E.
Figure 6:
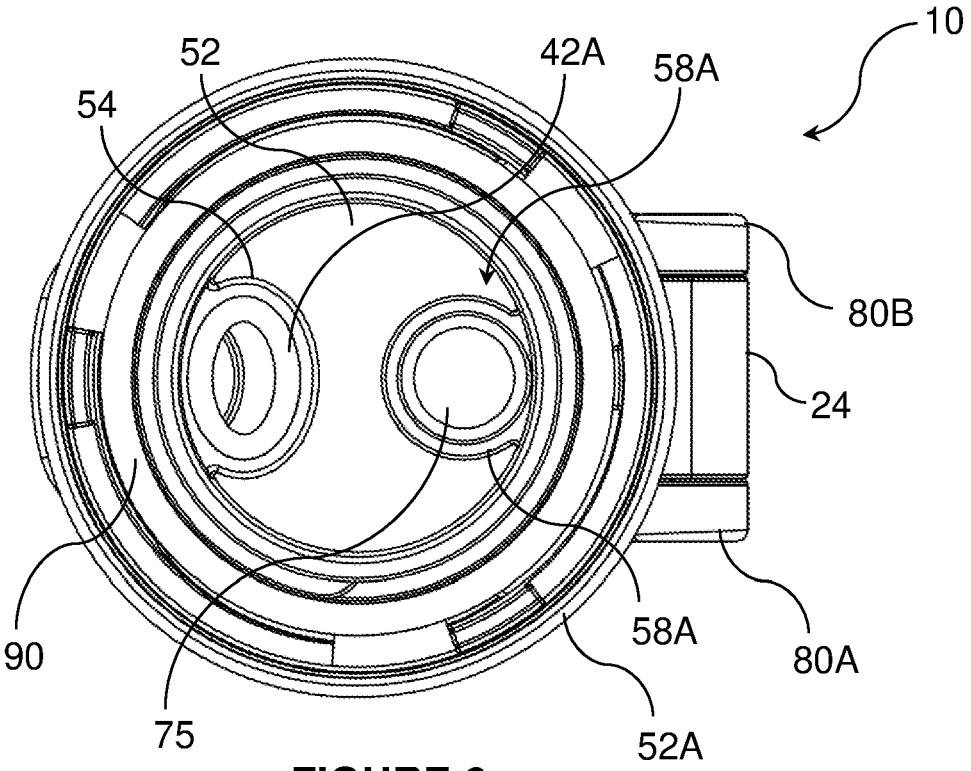
FIG. 6 shows an underside view of the cap assembly of FIGS. 1 to 3.

As shown in FIGS. 5 to 7, the aperture 58 is configured to receive a one-way valve 70 for use in equalising the pressure in the internal volume 225 of the fluid compartment 205 when the cap assembly 10 is coupled to the neck 210 of the fluid compartment 205.

Referring specifically to FIG. 7, the valve 70 includes a short rod 72 having a generally hemispherical shaped portion 75 located at one end and a generally truncated conical configuration at the opposing end of the rod 72 that has a diameter that is slightly larger at its base than the rest of the rod 72. When the cap assembly 10 is assembled, the generally hemispherical shaped portion 75 of the valve 70 is configured to locate within the circular aperture 58A at the lower surface of the body 52, while the generally conical end portion is located at the upper surface of the body 52, where is prevented from falling through the aperture 58 by virtue of the diameter of the base of the conical portion of the rod 72 being greater in size than that of the aperture 58. The cross hair arrangement of the aperture 58 ensures that air is able to flow through the cross hair arms when the one-way valve 70 is in place and the drinking vessel 200 is upright. While the generally hemispherical shaped portion 75 of the valve 70 ensures that fluid does not pass from the internal volume 225 of the fluid compartment 205 through the aperture 58 when the drinking vessel 200 is elevated to a drinking position.

Fluid Conduit

As indicated above, the cap assembly 10 further includes a fluid conduit 40, which is operably coupled for fluid communication between the aperture 54 in the body 52 of the base portion 50 and the outlet 26A at the sloping upper portion 26 of the head portion 20 to enable a fluid to flow therebetween.

As shown in FIG. 7, the fluid conduit 40 is of a generally tubular construction and includes a base portion 42 having an inlet 42A at one end, a tubular mid-portion 45 that extends from an opposing end of the base portion 42, and an upper portion 48 that extends from an opposing end of the mid-portion 45 where it terminates with an outlet 48A having a sloped lip.

The base portion 42 of the fluid conduit 40 is sized to locate snugly within the base portion 67 of the support structure 66 and the aperture 54 that extends through the circular body 52, the tubular mid-portion 45 is sized to be received by the arcuate shaped mid-portion 68 and upper portion 69 of the support structure 66, and the outlet 48A of the fluid conduit 40 is sized to locate within the aperture 26A at the sloping upper portion 26 of the housing 22, where the sloped lip of the outlet 48A lies flush with the sloping surface of the upper portion 26.

The tubular mid-portion 45 of the fluid conduit 40 is manufactured from a material that is sufficiently flexible to allow the mid-portion 45 to be compressed when a pressure is applied thereto. In a preferred form, the material is a food grade rubber such as silicone rubber.

Sealing Ring

As shown in FIG. 7, the cap assembly 10 further includes a sealing ring 90 that is sized to fit between the coupling portion 51 and the skirt portion 52A of the base portion 50 and to abut against the lower surface of the body 52. The sealing ring 90 is ideally manufactured from a food grade material such as silicone rubber.

It will be appreciated by persons of ordinary skill in the relevant art that when the cap assembly 10 is coupled to the neck 210 of the fluid compartment 205, the lip at the opening defined by the neck 210 is forced against the sealing ring 90 to form a watertight seal.

Materials

In a preferred embodiment, the various components of the cap assembly 10 including the head portion 20, the base portion 50, the cover 80, the engagement member 30 are ideally manufactured from an engineering plastic that is free from plasticizers such as bisphenol A (BPA), or at least configured in some way to reduce the risk of an associated plasticizer leaching into the fluid contained within the fluid compartment 210. The engineering plastic may be selected from the group of plastics including but not limited to: polyethylene, polypropylene and polycarbonate.

Mechanism

The head portion 20 when mounted to the base portion 50, is configured to rotate relative to the base portion 50 according to a first direction, thereby causing the engagement member 30 to rotate and apply a pressure to the compressible portion 45 of the fluid conduit 40. The pressure reduces the bore size of the compressible portion 45, which in turn reduces the volume of fluid that can flow from the internal volume 225 of the fluid compartment 205 to the outlet 26A at the upper portion 26 of the housing 22 when the drinking vessel is elevated for drinking purposes.

Thus, when the head portion 20 is rotated relative to the base portion 50 according to a second direction that is opposite to the first direction, the engagement member 30 is caused to rotate and release the pressure on the compressible portion 45 of the fluid conduit 40, thereby increasing the flow of fluid from the internal volume 225 of the fluid compartment 205 to the outlet 26A.

Now that the structure of the cap assembly 10 and drinking vessel 200 and the mechanism have been described, the following describes how the different predetermined flow positions can be achieved.

Flow Positions

Referring specifically to FIGS. 18 to 21, there is shown in each figure, (a) a perspective view, and (b) a plan view of the cap assembly 10, in which an upper portion of the housing 22 of the head portion 20 has been removed for clarity, revealing only a lower portion of the housing 22 mounted to the base portion 50.

Generally, the head portion 20 is configured to rotate back and forth relative to the base portion 50 of the cap assembly 10 between a plurality of predetermined flow positions, wherein each flow position corresponds to a predetermined degree of pressure applied to the compressible portion 45 of the fluid conduit 40 by the engagement member 30 that alters the bore size of the compressible portion 45, which in turn, dictates the volume of fluid contained within the internal volume 225 of the fluid compartment 210 that flows to the outlet 48A of the fluid conduit 40 and on to the outlet 26A at the upper portion 26 of the housing 22 when the drinking vessel is elevated for drinking purposes.

Indeed, as the head portion 20 rotates, the straight-edged portion of the engagement member 30 is caused to rotate relative to the compressible portion 45 of the fluid conduit 40 such that the corner at one end of the straight edged portion is gradually brought closer toward the compressible tubular portion 45. This in turn, causes an increasing degree of pressure to be applied to the compressible tubular portion 45, causing the bore of the compressible portion 45 to be reduced in size, and the flow of fluid through the fluid conduit 40 to the outlet 26A to be reduced accordingly.

The following describes the relationship between the degree of pressure applied to the compressible tubular portion 45 of the fluid conduit 40 and the degree of rotation of the head portion 20 relative to the base portion 50.

Full-Flow Position

Figure 18A:
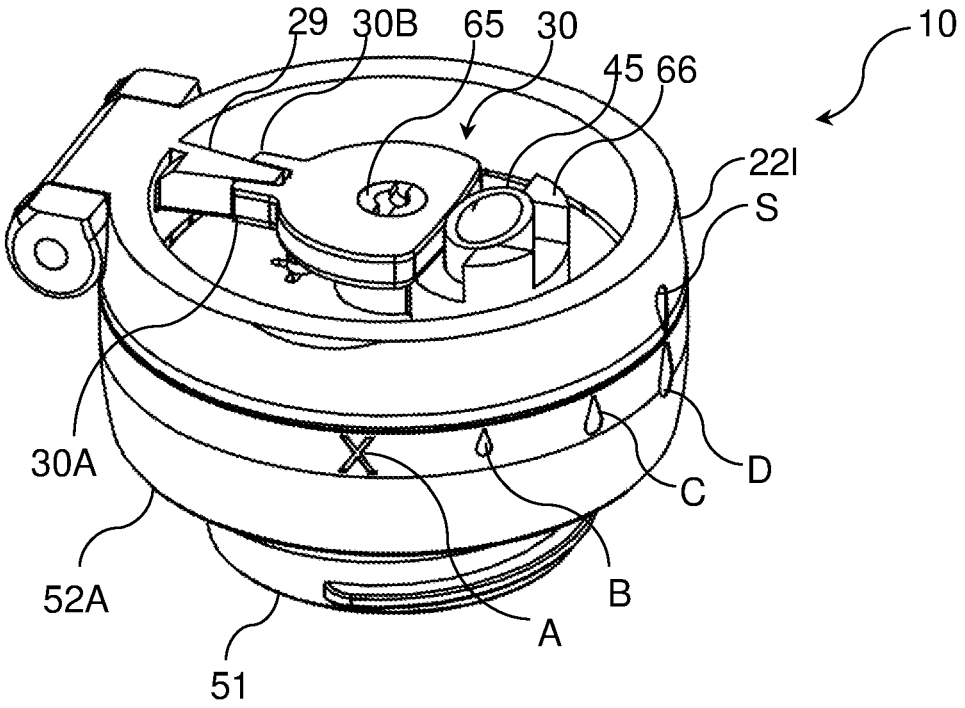
FIG. 18 shows (a) a perspective view and (b) a plan view, respectively, of a lower portion of the head portion of FIGS. 8 to 11 (a remaining upper portion of the head portion having been removed for clarity), rotatably coupled to the base portion of FIG. 12, in which a portion of an engagement member mounted to the head portion is caused to merely engage a compressible portion of a fluid conduit extending through the base portion with only a minimal degree of pressure, thereby realising a FULL-FLOW POSITION.
Figure 18B:
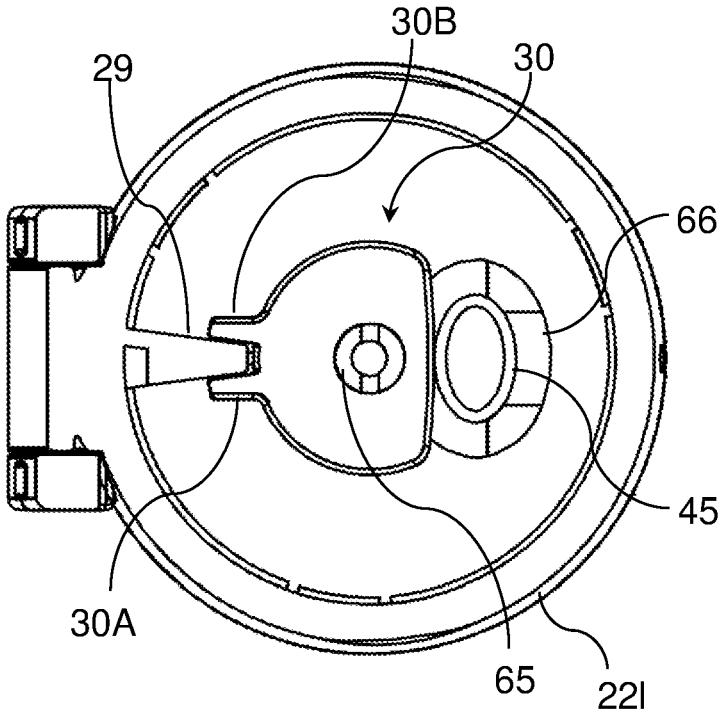

Referring firstly to FIG. 18(*a*), the head portion 20 is shown as having been rotated relative to the base portion 50 to a first predetermined flow position in which the selector indicator S at the lower portion 221 of the housing 22 is aligned with indicator D on the skirt portion 52A of the base portion 50. As shown in FIGS. 18(*a*) and 18(*b*), this corresponds to the situation in which only a central portion of the straight-edged portion of the engagement member 30 engages the compressible tubular portion 45 of the fluid conduit 40, and just with a pressure that is insufficient to reduce the bore size of the compressible tubular portion 45. This means that when the drinking vessel 200 is elevated to a drinking position, fluid contained within the internal volume 225 of the fluid compartment 205 is able to flow freely from the opening in the neck 210 through the fluid conduit 40 to the outlet 26A, from which a user could drink from when the cover 80 is in the open configuration.

Closed Position

Figure 21A:
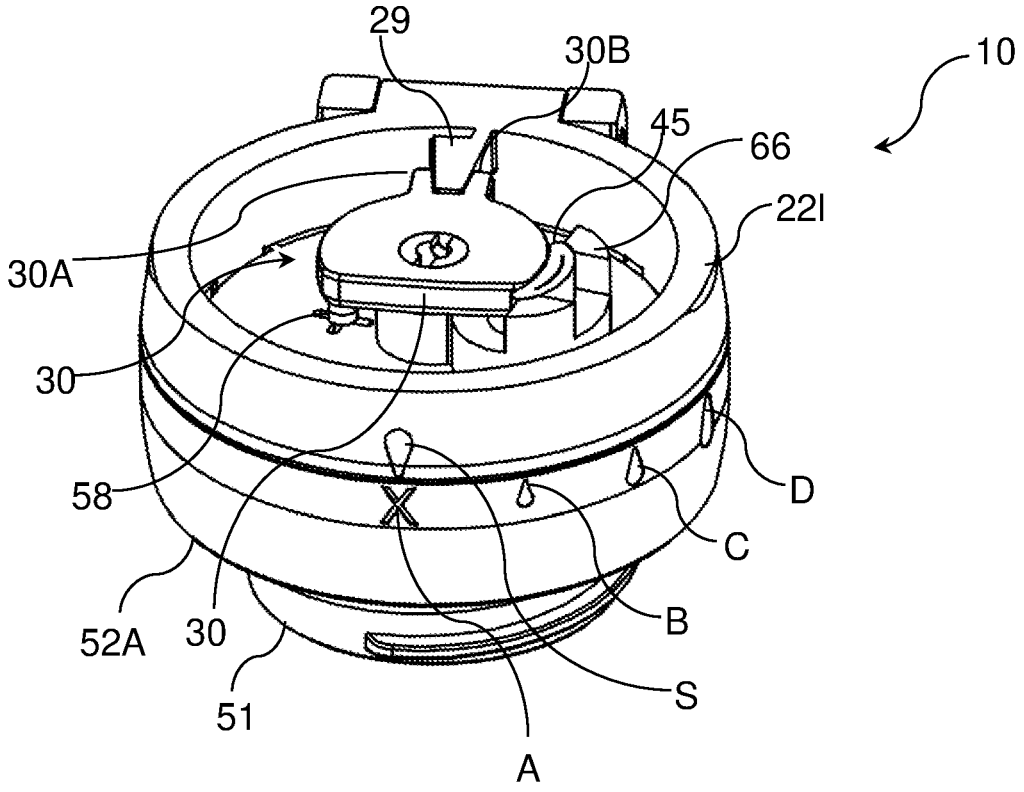
FIG. 21 shows (a) a perspective view and (b) a plan view, respectively, of a lower portion of the head portion of FIGS. 8 to 11 (a remaining upper portion of the head portion having been removed for clarity), rotatably coupled to the base portion of FIG. 12, in which a portion of an engagement member mounted to the head portion is caused to compress a compressible portion of a fluid conduit extending through the base portion as the head portion is rotated relative to the base portion with a pressure that is sufficient to realise a CLOSED POSITION.
Figure 21B:
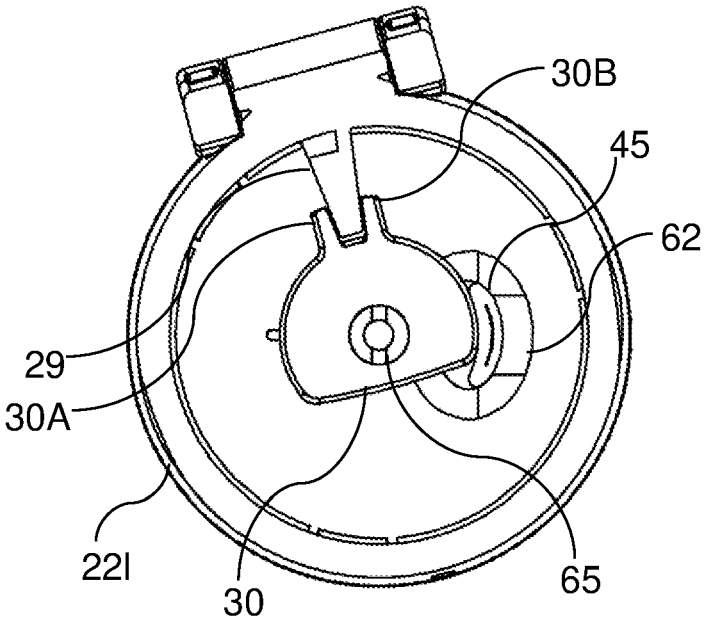

Referring next to FIG. 21(*a*), the head portion 20 is shown as having been rotated relative to the base portion 50 to a second predetermined flow position in which the selector indicator S is aligned with indicator A. As shown in FIGS. 21(*a*) and 21(*b*), this corresponds to the situation in the engagement member 30 has been rotated to a position where the corner portion adjacent the straight-edged portion of the engagement member 30, which includes a portion of the semi-circular portion of the body is now fully engaged with the compressible tubular portion 45 of the fluid conduit 40, such that the degree of pressure applied to the compressible portion 45 is sufficient to reduce the bore size of the compressible portion completely, effectively stemming the flow of fluid through the fluid conduit 40 when the drinking vessel 200 is elevated to a drinking position.

Mid-Flow Position

Figure 19A:
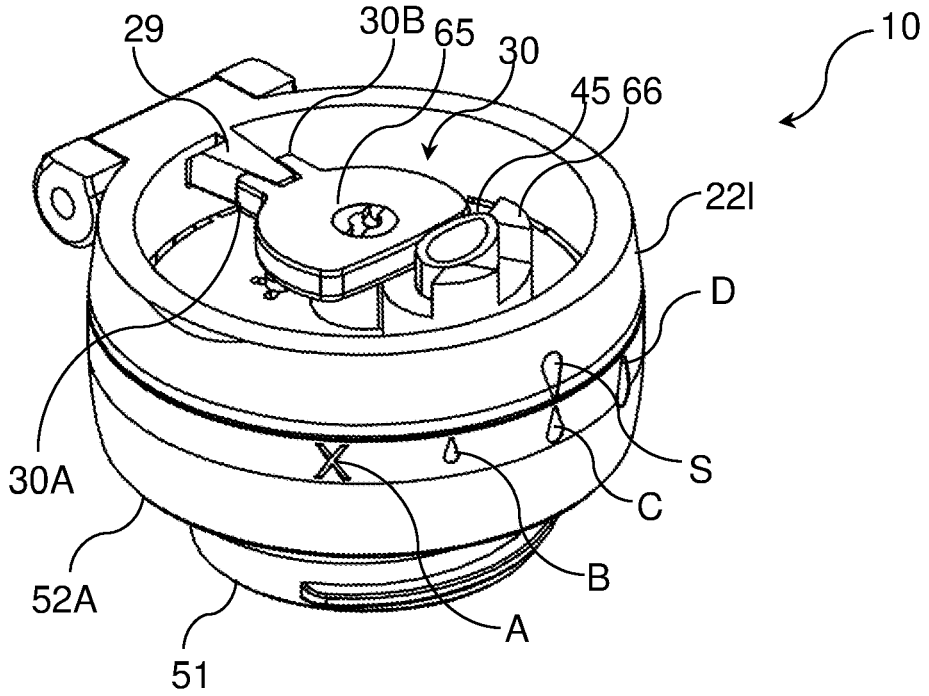
FIG. 19 shows (a) a perspective view and (b) a plan view, respectively, of a lower portion of the head portion of FIGS. 8 to 11 (a remaining upper portion of the head portion having been removed for clarity), rotatably coupled to the base portion of FIG. 12, in which a portion of an engagement member mounted to the head portion is caused to compress a compressible portion of a fluid conduit extending through the base portion as the head portion is rotated relative to the base portion with a pressure that is sufficient to realise a MID-FLOW POSITION.
Figure 19B:
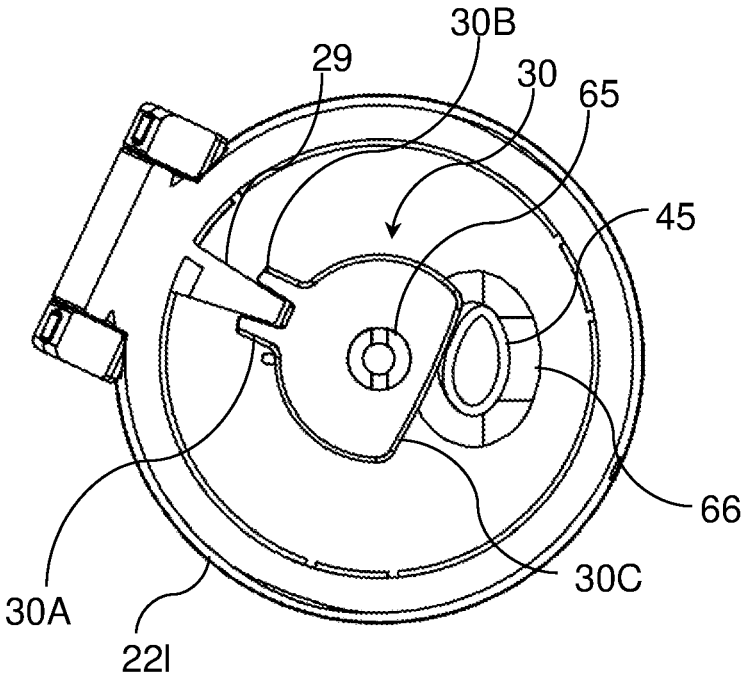

Referring next to FIG. 19(*a*), the head portion 20 is shown as having been rotated relative to the base portion 50 to a third predetermined flow position in which the selector indicator S is aligned with indicator C. As shown in FIGS. 19(*a*) and 19(*b*), this corresponds to the situation in which the engagement member 30 has been rotated to a position where one end portion of the straight-edged portion now engages the compressible tubular portion 45 of the fluid conduit 40. The degree of pressure applied to the compressible portion 45 is sufficient to cause the bore of the compressible tubular portion 45 to be reduced to a size that is less than that observed in FIGS. 18(*a*) and 18(*b*), but greater than that observed in FIGS. 21(*a*) and 21(*b*). This means that when the drinking vessel 200 is elevated to a drinking position, fluid contained within the internal volume 225 of the fluid compartment 205 is able to flow through the fluid conduit 40 to the outlet 26A, albeit less freely than when compared to when the head portion 20 is rotated to the FULL-FLOW POSITION.

Low-Flow Position

Figure 20A:
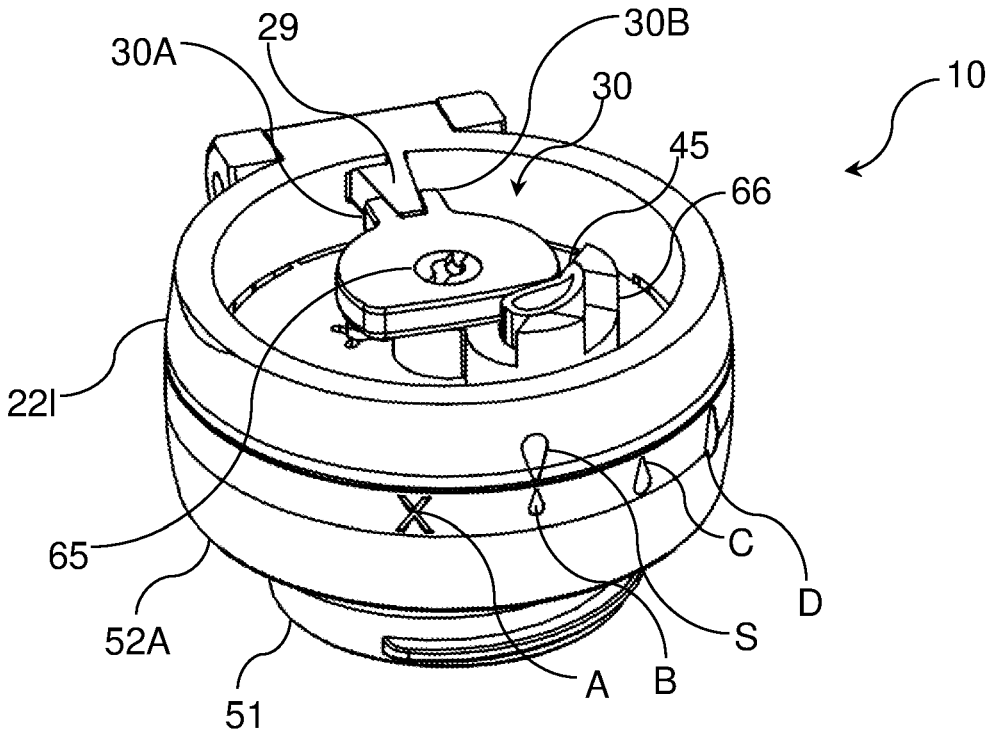
FIG. 20 shows (a) a perspective view and (b) a plan view, respectively, of a lower portion of the head portion of FIGS. 8 to 11 (a remaining upper portion of the head portion having been removed for clarity), rotatably coupled to the base portion of FIG. 12, in which a portion of an engagement member mounted to the head portion is caused to compress a compressible portion of a fluid conduit extending through the base portion as the head portion is rotated relative to the base portion with a pressure that is sufficient to realise a LOW-FLOW POSITION.
Figure 20B:
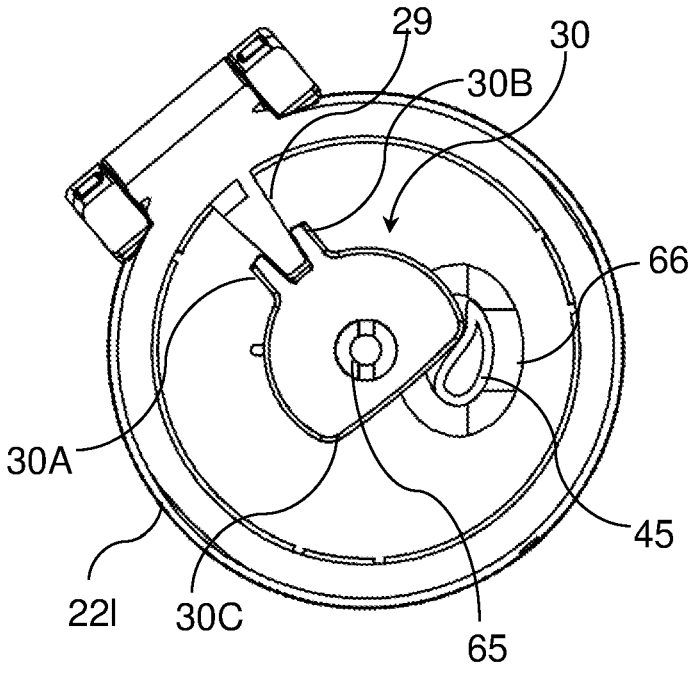

Referring lastly to FIG. 20(*a*), the head portion 20 is shown as having been rotated relative to the base portion 50 to a fourth predetermined flow position in which the selector indicator S is aligned with indicator B. As shown in FIGS. 20(*a*) and 20(*b*), this corresponds to the situation in which a substantial portion of the corner at the end of the straight-edged portion now engages the compressible tubular portion 45 of the fluid conduit 40. The degree of pressure applied to the compressible portion 45 is sufficient to cause the bore of the compressible tubular portion 45 to be reduced to a size that is less than that observed in FIGS. 19(*a*) and 19(*b*), but greater than that observed in FIGS. 21(*a*) and 21(*b*). This means that when the drinking vessel 200 is elevated to a drinking position, fluid contained within the internal volume 225 of the fluid compartment 205 is still able to flow through the fluid conduit 40 to the outlet 26A, albeit less freely than when compared to when the head portion 20 is rotated to the MID-FLOW POSITION.

Drinking Vessel (Single-Walled)

Referring to FIGS. 16 to 17, there is provided a drinking vessel 200 according to another preferred embodiment of the present invention.

The drinking vessel 200 includes the cap assembly 10 described above, and a fluid container 205, whereby the coupling portion 51 of the base portion 50 of the cap assembly 10 is configured for removably coupling to a neck 210 of the fluid container 205 to define a single-walled vessel.

As shown in these figures, the fluid container body 205 takes the form of a generally circular base and a wall upstanding from the base to define a generally cylindrical elongated body that slopes gently inwards to define a shoulder portion that then terminates in a generally tubular neck 210 having an outwardly rolled lip at a terminal end thereof to ensure that the sharp terminal end is safely directed towards the external surface of the neck 210 for safety reasons.

The neck 210 defines an opening that is sized to receive a fluid substantially there for the purpose of storing/transporting within an internal volume 225 defined by the base and the wall of the container body 205.

As shown in the cross sectional side view in FIG. 17, a screw threaded portion is formed at the inner surface of the neck 210 that is complementary to the screw threaded portion formed at the external surface of the coupling portion 51 of the base portion 50.

For the purposes of the preferred embodiments of the present invention, it will be appreciated by persons of ordinary skill in the relevant art that the fluid container 205 of this single-walled vessel is required to be manufactured from a material that is devoid of potentially harmful compounds that may leach into the internal volume 225 of the fluid container 205. In this respect, the inventors have employed stainless steel, and more specifically, a food grade stainless steel such as 304 stainless steel or 316 stainless steel.

Drinking Vessel (Double-Walled)

As described above, and as shown in FIGS. 16 and 17, the fluid container 205 is formed as a single-walled vessel for the purpose of storing/transporting fluids, where the temperature of the fluids contained within the internal volume 225 of the fluid container 205 is not a major concern.

However, it will be readily appreciated by those persons of ordinary skill in the art that where the temperature of the fluids is of concern, then the fluid container 205 can be manufactured as a double-walled vessel (not shown) having an insulation gap defined between an inner wall and an outer wall of the container body that is filled with either a partial vacuum or an insulating material such as insulating foam to provide hot and cold temperature insulation between the fluids contained within the internal volume 225 of the fluid container 205 and the external environment.

Whilst not shown in any of the figures, the double-walled vessel is ideally formed by utilising the same single-walled fluid container 205 described above to define the inner wall, (inner) base, and neck 210 of the double-walled vessel. The outer walled part of the double-walled vessel takes the form of a second container (not shown) manufactured in much the same way as the fluid container 205 of the single-walled vessel 200, namely having a generally circular base and a wall upstanding from the base to define a generally cylindrical elongated body that slopes gently inwards to define a shoulder portion but without a neck. The dimensions of the as-formed cylindrical container (hereinafter referred to as the outer container) are larger than those of the fluid container 205 (hereinafter referred to as the inner container) to allow the inner container 205 to be received within the outer container and still define an insulation gap therebetween. The outer container is then joined to the inner container 205 at the neck 210 using a suitable joining technique.

Since the outer container of the double-walled vessel is unlikely to make contact with the fluids contained within the internal volume 225 defined by the inner container 205, then the outer container can be made from a non-food grade metal or engineering plastic, provided that the metal or plastic chosen is sufficiently robust to maintain a partial vacuum in the insulation gap. In a preferred form, the outer container body is manufactured from stainless steel and joined to the food grade stainless steel inner container 205 at the neck 210 by welding.

Advantages

Among other advantages, the variable flow cap assembly 10 for a drinking vessel 200 according to the preferred embodiments of the present invention provides the means by which to selectively control the amount of fluid that flows from the internal volume 225 of the fluid compartment 210 of the drinking vessel 200 to the outlet 26A.

Other Embodiments

It will be appreciated by those skilled in the relevant art that the embodiments of the present invention above are not limited to what has been described.

For instance, in other embodiments, the number of flow positions is not limited to the four positions described above, but may include more or less as desired.

In other embodiments, the coupling portion 51 of the base portion 50 described above may be modified to enable the cap assembly 10 to be retrofitted to any drinking vessel. For instance, the size and/or the threaded portion of the coupling portion 51 may be altered to complement those associated with the neck of other drinking vessels. Indeed, it will be appreciated by those skilled in the relevant art that the coupling portion 51 described above is not limited to a threaded portion disposed about its external surface. Rather, the threaded portion may be disposed about the inner surface of the coupling portion for use in screw threaded engagement with a neck of a drinking vessel that includes a threaded portion disposed about the external surface of the neck. It will be appreciated in this instance that the sealing ring 90 would necessarily be configured to locate within the cavity of the coupling portion 51 for use in engaging the upper surface of the neck of the drinking vessel. It will also be appreciated that the pitch of the screw threaded portion may be changed to complement the pitch of the screw threaded portion at the neck of the other drinking vessel(s).

In other embodiments, the fluid conduit 40 described above is not limited to the length shown in the figures. For instance, the fluid conduit 40 may be extended in length at both ends so that the base portion 42 and inlet 42A locate within the internal volume 225 of the drinking vessel 200 and the upper portion 48 and outlet 48A extend through the outlet 26A at the upper portion 26 of the housing 22 to enable the modified fluid conduit to be employed as a straw for drinking purposes.

In other embodiments, the cap assembly 10 may include a handle (not shown). For instance, in one arrangement, the handle may be pivotably mounted to the hinge bracket 24 at the rear of the head portion 20. Such an arrangement may be achieved by employing a handle that takes the form of an elongate rod bent into a generally U-shaped ring with opposing end portions that are spaced apart by a distance that enables the two ends to locate either side of the hinge arms 80A, 80B of the cover 80. The two opposing end portions may each be configured with an aperture that extends through the end portion for use in receiving an extended version of the spindle 25 as it passes substantially through the apertures in the hinge arms 80A, 80B and the aperture 24A extending through the hinge bracket 24. Alternatively, the two end portions of the handle may simply be angled to extend through the corresponding apertures of the hinge arms 80A, 80B and the aperture 24A of the hinge bracket 24, thereby replacing the spindle 25 completely.

Definitions

Whenever a range is given in the specification, for example, a temperature range, a time range, or concentration range, all intermediate ranges and subranges, as well as all individual values included in the ranges given are intended to be included in the disclosure. It will be understood that any subranges or individual values in a range or subrange that are included in the description herein can be excluded from the claims herein.

All definitions, as defined and used herein, should be understood to control over dictionary definitions, definitions in documents incorporated by reference, and/or ordinary meanings of the defined terms.

Throughout this application, the term "about" is used to indicate that a value includes the inherent variation of error for the device, the method being employed to determine the value, or the variation that exists among the study subjects.

The indefinite articles "a" and "an," as used herein in the specification, unless clearly indicated to the contrary, should be understood to mean "at least one."

The phrase "and/or," as used herein in the specification, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

Spatially relative terms, such as "inner," "outer," "beneath," "below," "lower," "above," "upper," and the like, may be used herein for ease of description to describe one element or feature's relationship to another element(s) or feature(s) as illustrated in the Figures. Spatially relative terms may be intended to encompass different orientations of the device in use or operation in addition to the orientation depicted in the Figures.

While the invention has been described in conjunction with a limited number of embodiments, it will be appreciated by those skilled in the art that many alternatives, modifications and variations in light of the foregoing description are possible. Accordingly, the present invention is intended to embrace all such alternatives, modifications and variations as may fall within the spirit and scope of the invention as disclosed.

Where the terms "comprise", "comprises", "comprised" or "comprising" are used in this specification (including the claims) they are to be interpreted as specifying the presence of the stated features, integers, steps or components, but not precluding the presence of one or more other features, integers, steps or components, or group thereof.

The invention claimed is:

1. A cap assembly, including:

a base portion configured for removably coupling to a neck of a fluid compartment of a drinking vessel and including an aperture in fluid communication with an internal volume of the fluid compartment via an opening at the neck;

a head portion rotatably coupled to the base portion;

a fluid conduit operably coupled between the aperture at the base portion and an outlet at an upper end of the head portion to enable a fluid to flow therebetween; and an engagement member mounted to the head portion and shaped to engage a compressible portion of the fluid conduit, wherein the head portion is configured to rotate about a longitudinal axis relative to the base portion according to a first direction, in which the engagement member is caused to rotate and apply a pressure to the compressible portion of the fluid conduit to reduce a flow of fluid from the internal volume of the fluid compartment to the outlet, and according to a second direction that is opposite to the first direction, in which the engagement member is caused to rotate and release the pressure on the compressible portion of the fluid conduit to increase the flow of fluid from the internal volume of the fluid compartment to the outlet, and the head portion rotates relative to the base portion between a plurality of predetermined flow positions, wherein each flow position corresponds to a predetermined degree of pressure applied to the compressible portion of the fluid conduit by the engagement member to alter the bore size of the compressible portion.

2. The cap assembly according to claim 1, wherein when the head portion is rotated relative to the base portion to a first predetermined flow position, the degree of pressure applied to the compressible portion by the engagement member is insufficient to reduce the bore size of the compressible portion, thereby defining a FULL-FLOW position.

3. The cap assembly according to claim 2, wherein when the head portion is rotated relative to the base portion to a second predetermined flow position, the degree of pressure applied to the compressible portion by the engagement member is sufficient to reduce the bore size of the compressible portion completely, thereby defining a CLOSED position.

4. The cap assembly according to claim 3, wherein when the head portion is rotated relative to the base portion to a third predetermined flow position intermediate of the first and second predetermined flow positions, the degree of pressure applied to the compressible portion by the engagement member is less than the pressure applied to the compressible portion in respect of the CLOSED position, but greater than the pressure applied to the compressible portion in respect of the FULL-FLOW position such that the compressible portion has a bore size that is intermediate of the bore sizes corresponding to the CLOSED position and the FULL-FLOW position, thereby defining a MID-FLOW position.

5. The cap assembly according to claim 1, wherein the engagement member includes a generally semi-circular body having a straight-edged portion oriented to engage the compressible portion of the fluid conduit in at least one of the plurality of predetermined positions and a semi-circular portion including mounting means located distal to the straight-edged portion for mounting the engagement member to the head portion.

6. The cap assembly according to claim 5, wherein the body of the engagement member includes an aperture that extends substantially therethrough and the base portion includes a rotation mount upstanding from the body for rotatably mounting the engagement member to the rotation mount via the aperture.

7. The cap assembly according to claim 1, wherein the base portion includes at least one arcuate groove configured with one or more indents disposed along an internal surface of the arcuate groove in spaced apart arrangement, and the head portion includes at least one projection depending from a lower surface thereof, the at least one projection configured to locate at least partially within the at least one arcuate groove and engage with the one or more indents to provide a positive indication that the head portion has been rotated to a selected one of the plurality of predetermined flow positions when the at least one projection engages a corresponding one of the one or more indents disposed along the internal surface of the at least one arcuate groove.

8. The cap assembly according to claim 1, wherein the base portion further includes a plurality of indicators located on an external surface thereof, each indicator corresponding to one of the plurality of predetermined flow positions.

9. The cap assembly according to claim 1, wherein the base portion is removably coupled to the neck of the fluid compartment by screw threaded engagement.

10. The cap assembly according to claim 1, wherein at least one of the head portion and the base portion is manufactured from an engineering plastic.

11. The cap assembly according to claim 10, wherein the engineering plastic is plasticizer-free.

12. The cap assembly according to claim 1, further including a cover for covering the outlet when not in use.

13. The cap assembly according to claim 12, wherein the cover is pivotably coupled to the head portion.

14. The cap assembly according to claim 1, wherein at least the compressible portion of the fluid conduit is manufactured from silicone rubber.

15. The cap assembly according to claim 1, further including a handle pivotably coupled to the head portion.

16. A drinking vessel, including:

a fluid compartment having a neck with an opening and an internal volume sized to contain a fluid; and a cap assembly removably coupled to the neck of the fluid compartment, the cap assembly including a base portion configured for removably coupling to a neck of a fluid compartment of a drinking vessel and including an aperture in fluid communication with an internal volume of the fluid compartment via an opening at the neck;

a head portion rotatably coupled to the base portion;

a fluid conduit operably coupled between the aperture at the base portion and an outlet at an upper end of the head portion to enable a fluid to flow therebetween; and an engagement member mounted to the head portion and shaped to engage a compressible portion of the fluid conduit, wherein the head portion is configured to rotate about a longitudinal axis relative to the base portion according to a first direction, in which the engagement member is caused to rotate and apply a pressure to the compressible portion of the fluid conduit to reduce a flow of fluid from the internal volume of the fluid compartment to the outlet, and according to a second direction that is opposite to the first direction, in which the engagement member is caused to rotate and release the pressure on the compressible portion of the fluid conduit to increase the flow of fluid from the internal volume of the fluid compartment to the outlet, and the head portion rotates relative to the base portion between a plurality of predetermined flow positions, wherein each flow position corresponds to a predetermined degree of pressure applied to the compressible portion of the fluid conduit by the engagement member to alter the bore size of the compressible portion.

* * * * *